United States Patent [19]

Okamoto et al.

[11] 4,370,114

[45] Jan. 25, 1983

[54] SPINNERET ASSEMBLY FOR USE IN PRODUCTION OF MULTI-INGREDIENT MULTI-CORE COMPOSITE FILAMENTS

[75] Inventors: Miyoshi Okamoto, Takatsuki; Miyozo Asada, Kyoto, both of Japan

[73] Assignee: Toray Industries, Inc., Tokyo, Japan

[21] Appl. No.: 73,564

[22] Filed: Sep. 7, 1979

[51] Int. Cl.[3] ..... D01D 3/00

[52] U.S. Cl. ..... 425/131.5; 264/171; 425/463

[58] Field of Search ..... 425/131.1, 131.5, 463, 425/192 S; 264/171

[56] References Cited

U.S. PATENT DOCUMENTS

| | | | |
|---|---|---|---|
| 3,197,812 | 8/1965 | Dietzsh et al. | 425/382.2 |
| 3,500,498 | 7/1970 | Fukama et al. | 264/171 |
| 3,531,368 | 9/1970 | Okamoto et al. | 161/175 |
| 3,540,080 | 11/1970 | Goossens | 425/382.2 |
| 3,692,423 | 9/1972 | Okamoto et al. | 425/131 |
| 3,716,614 | 2/1973 | Okamoto et al. | 264/344 |
| 4,165,556 | 8/1979 | Nishida et al. | 264/171 |

FOREIGN PATENT DOCUMENTS

| | | | |
|---|---|---|---|
| 2014817 | 11/1970 | Fed. Rep. of Germany | 264/171 |
| 2055070 | 5/1971 | France | 425/464 |
| 2058144 | 9/1971 | France | 425/382.2 |
| 43-28771 | 12/1968 | Japan | 264/171 |
| 44-7374 | 4/1969 | Japan | 425/131.5 |
| 44-18369 | 8/1969 | Japan | 264/171 |
| 45-6299 | 3/1970 | Japan | 264/171 |
| 46-27775 | 8/1971 | Japan | 264/171 |
| 47-3842 | 2/1972 | Japan | 264/171 |
| 47-32134 | 8/1972 | Japan | 264/171 |
| 47-33733 | 8/1972 | Japan | 264/171 |
| 47-39726 | 10/1972 | Japan | 264/171 |
| 48-28963 | 9/1973 | Japan | 264/171 |
| 48-43562 | 12/1973 | Japan | 425/461 |
| 1263221 | 2/1972 | United Kingdom . | |
| 1300268 | 12/1972 | United Kingdom . | |
| 1306974 | 2/1973 | United Kingdom . | |
| 1313767 | 4/1973 | United Kingdom . | |
| 1325776 | 8/1973 | United Kingdom . | |

*Primary Examiner*—Jay H. Woo

*Attorney, Agent, or Firm*—Austin R. Miller

[57] ABSTRACT

A spinneret assembly to be fitted in a spinning pack for the production of multi-ingredient, multi-core composite fibers, each of which is comprised of at least three polymer phases. The assembly includes four plate members which form a plurality of series of linked polymer passages in which at least three of the plate members are capable of being assembled into a single unit by connecting means so that these plate members can be fitted in or detached from the spinning pack as a single unit.

8 Claims, 97 Drawing Figures

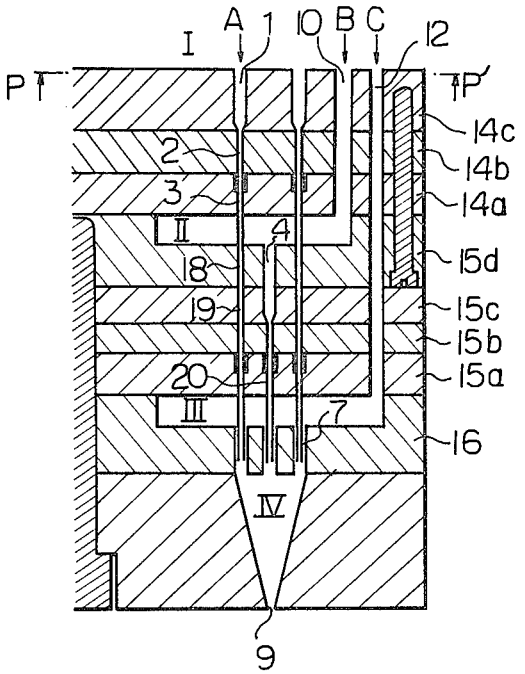
Fig. 16A
Fig. 16C
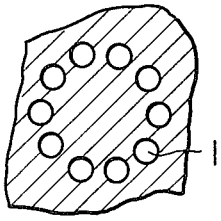
Fig. 16B
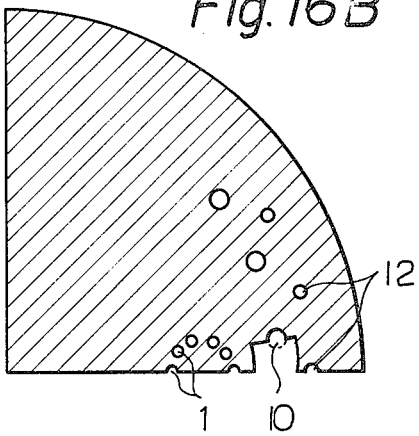

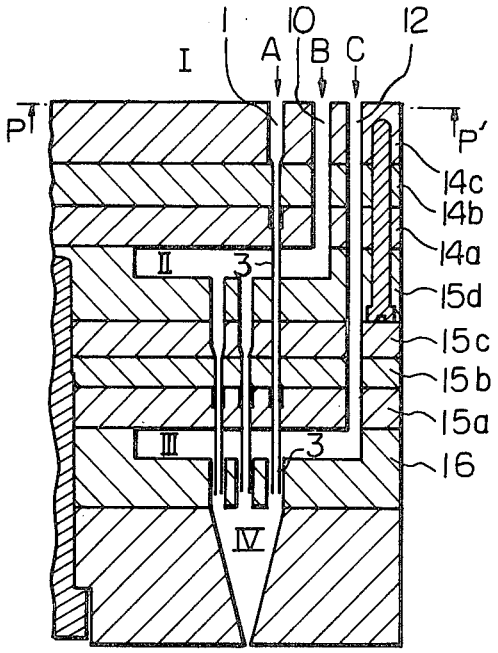
Fig. 17A
Fig. 17B
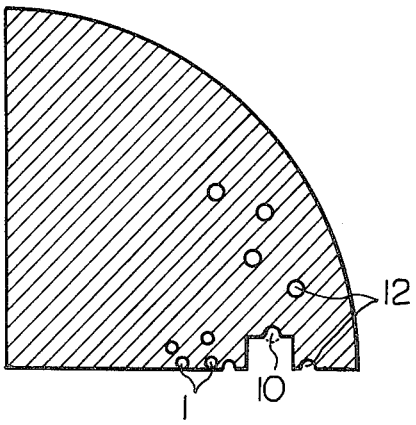
Fig. 17C
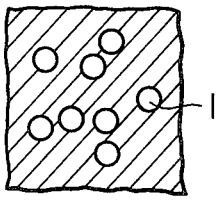

SPINNERET ASSEMBLY FOR USE IN PRODUCTION OF MULTI-INGREDIENT MULTI-CORE COMPOSITE FILAMENTS

BACKGROUND OF THE INVENTION (1) Field of the Invention

This invention relates to a spinneret assembly to be fitted in a spinning pack for the production of multi-ingredient, multi-core composite filaments, each of which is comprised of at least three polymer phases.

(2) Description of the Prior Art

Multi-ingredient, multi-core filaments are composed of a plurality of core polymer ingredients and an intervening polymer ingredient, both the core and intervening ingredients extending over the the entire length of the filaments. Each filament possesses a substantially uniform cross-section, wherein a plurality of the core polymer ingredients are dispersed in or partitioned off by the intervening polymer ingredient. Such multi-ingredient, multi-core filaments are particularly useful for the production of extremely fine filaments. That is, extremely fine filaments can be obtained therefrom by separating the respective ingredients from each other or removing the intervening ingredient therefrom.

Many proposals have been heretofore made for the production of multi-ingredient, multi-core filaments, each of which is comprised of at least three polymer phases. However, conventional spinning apparatuses for the production of such multi-ingredient, multi-core filaments have some of the following defects.

(1) The resulting composite filaments are not uniform in thickness and/or in cross section.

(2) The number of core polymer ingredients in each composite filament is limited.

(3) It is troublesome to assemble the parts into a spinning pack or disassemble the spinning pack, and furthermore, it is difficult to maintain a high precision after the repeated disassembling and assembling.

(4) Troubles occur during the operation of the spinning pack, for example, the polymer ingredients are contaminated with each other, or a specified polymer ingredient exhibits an unusually long dwell time in the spinning pack.

SUMMARY OF THE INVENTION

It is the main object of the present invention to provide a spinneret assembly to be fitted in a spinning pack for the production of multi-ingredient, multi-core composite filaments, which assembly does not have the above-mentioned defects.

Other objects and advantages of the present invention will be apparent from the following description.

In one aspect of the present invention, there is provided a spinneret assembly to be fitted in a spinning pack for the production of multi-ingredient, multi-core composite filaments, each being comprised of at least three polymer phases A, B and C, which assembly comprises superposed rigid plate members Q, R, S and T;

said plate member Q partitioning off a polymer chamber I, through which a stream of the polymer A flows, from a polymer chamber II or III, through which a stream of the polymer B or C flows, respectively;

said plate member R partitioning off the polymer chamber II from the polymer chamber III;

said plate member S partitioning off the polymer chamber III from one or more funnel-shaped polymer chambers IV bored in the plate member T, through which combined streams of the polymers A, B and C flow, and said plate member S having bored therein a plurality of holes, the lowermost ends of which are exposed to the or each funnel-shaped polymer chamber IV;

said plate member T having at the lowermost end of the or each funnel-shaped polymer chamber IV an orifice through which a combined stream of the polymers A, B and C flows;

said plate member R having bored therein a plurality of holes confronting the holes of the plate member S, each pair of confronting holes being connected with each other by a pipe, said pipe extending from the hole of the plate member R toward the hole of the plate member S or from the hole of the plate member S toward the hole of the plate member R so that a narrow circular path is formed at least around one end portion of said pipe within the hole of the plate member R or S or within another pipe extending from the hole of the plate member R or S, and the polymer passage formed within said pipe being connected through said narrow circular path to the polymer chamber III;

said plate members Q, R, S and T forming a plurality of series of linked polymer passages, each series having at least one joining point at which two polymer streams join together, at least one of the polymer passages upstream of the joining point having at least one cross section that is narrower than any cross section of the polymer passage downstream of the joining point but upstream of the succeeding joining point, if any, or said at least one polymer passage upstream of the joining point having a length longer than that of the polymer passage downstream of the joining point but upstream of the succeeding joining point, if any.

In another aspect of the present invention, there is provided a spinneret assembly to be fitted in a spinning pack for the production of multi-ingredient, multi-core composite filaments, each being comprised of at least three polymer phases A, B and C, which assembly comprises superposed rigid plate members Q, R, S and T;

said plate member Q partitioning off a polymer chamber I, through which a stream of the polymer A flows, from a polymer chamber II or III, through which a stream of the polymer B or C flows, respectively;

said plate member R partitioning off the polymer chamber II form the polymer chamber III;

said plate member S partioning off the polymer chamber III from one or more funnel-shaped polymer chambers IV bored in the plate member T, through which combined streams of the polymers A, B and C flow, and said plate member S having bored therein a plurality of holes, the lowermost ends of which are exposed to the or each funnel-shaped polymer chamber IV;

said plate member T having at the lowermost end of the each funnel-shaped polymer chamber IV an orifice through which a combined stream of the polymers A, B and C flows;

said plate member S further having bored therein one or more slits through which streams of the polymer C flow from the polymer chamber III to the funnel-shaped polymer chamber IV, the or each slit being, on the under surface of the plate member S, of a multi-arm shape having at least three radially extending arms, each of which intervenes between at least two holes of the holes bored in the plate member S;

said plate members Q, R, S and T forming a plurality of series of linked polymer passages, each series having at least one joining point at which two polymer streams join together, at least one of the polymer passages upstream of the joining point having at least one cross section that is narrower than any cross section of the polymer passage downstream of the joining point but upstream of the succeeding joining point, if any, or said at least one polymer passage upstream to the joining point having a length longer than that of the polymer passage downstream of the joining point but upstream of the succeeding joining point, if any.

BRIEF DESCRIPTION OF THE DRAWINGS

The features of the present invention will now be described in detail with reference to the accompanying drawings, in which:

FIG. 16A is a vertical sectional view of a part of still another embodiment of the spinneret assembly of the invention;

FIG. 16B is a transverse sectional view of a part of the spinneret assembly sectioned along the line P—P' indicated in FIG. 16A;

FIG. 16C is an enlarged view of a part of the section of the spinneret assembly illustrated in FIG. 16B;

FIG. 17A is a vertical sectional view of a part of still another embodiment of the spinneret assembly of the invention;

FIG. 17B is a transverse sectional view of a part of the spinneret assembly sectioned along the line P—P' indicated in FIG. 17A;

FIG. 17C is an enlarged view of a part of the section of the spinneret assembly illustrated in FIG. 17B;

DESCRIPTION OF THE PREFERRED EMBODIMENTS OF THE INVENTION

Figure 1A:
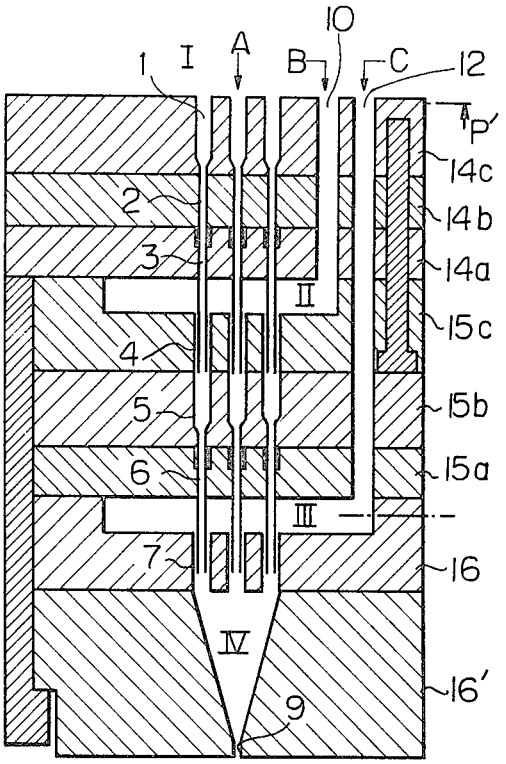
FIG. 1A is a vertical sectional view of a part of a preferred embodiment of the spinneret assembly of the invention.
Figure 1B:
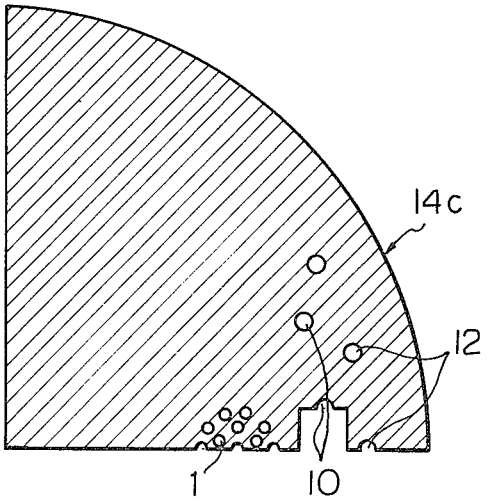
FIG. 1B is a transverse cross-sectional view of a part of the spinneret assembly sectioned along the line P—P' indicated in FIG. 1.
Figure 15A:
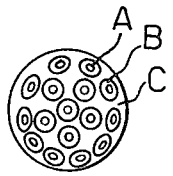
FIGS. 15A through 15L are cross-sectional views of composite filaments obtained by using the spinneret assemblies illustrated in FIGS. 1 and 6.
Figure 15B:
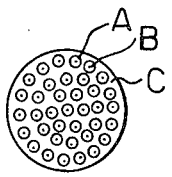
Figure 15C:
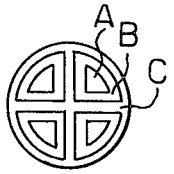
Figure 15D:
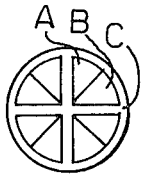
Figure 15E:
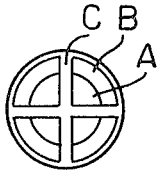
Figure 15F:
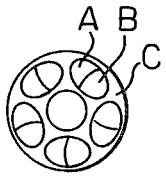
Figure 15G:
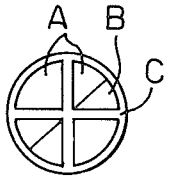
Figure 15H:
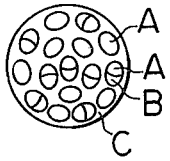
Figure 15I:
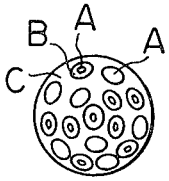
Figure 15J:
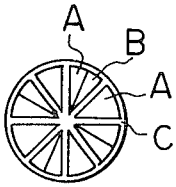
Figure 15K:
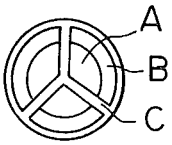
Figure 15L:
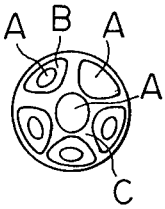

Referring to FIGS. 1A and 1B, a spinneret assembly is illustrated, which is used for the production of multi-ingredient multi-core composite filaments each of which is composed of 16 core polymer ingredients and an intervening polymer ingredient, both of the core and intervening polymer ingredients extending over the entire length of each filament. Each filament possesses a substantially uniform cross section wherein the 16 core ingredients are dispersed in the intervening ingredient in an islands-in-sea configuration as illustrated in FIG. 15A. Each of the core ingredients is comprised of a polymer A core and a polymer B sheath and the core A-sheath B ingredients are dispersed in the intervening polymer C ingredient as illustrated in FIG. 15A.

In the spinneret assembly illustrated in FIG. 1A, a polymer A, i.e., one polymer component of each core ingredient, is introduced from a polymer chamber I through relatively wide connecting holes 1, bored in a plate member 14*c*, into relatively narrow holes 2 bored in a plate member 14*b*. Then, each stream of the polymer A flows through pipe 3. A polymer B, i.e., the other polymer component of each core ingredient, is introduced through a hole 10, bored in the superposed plate members 14*c*, 14*b* and 14*a*, into a polymer chamber II formed between the plate member 14*a* and a plate member 15*c*. Then, the polymer B flows through circular paths formed around the pipes 3 within the holes 4 bored in the plate member 15*c*. Upon leaving the outlet of the pipe 3, each stream of the polymer A joins with each stream of the polymer B. Each combined stream of the polymers A and B flows through a connecting hole 5, bored in a plate member 15*b*, and then through a pipe 6. A polymer C, i.e., the intervening ingredient, is introduced through a hole 12, bored in the superposed plate members 14*c*, 14*b*, 14*a*, 15*c*, 15*b* and 15*a*, into a polymer chamber III formed between the plate member 15*a* and a plate member 16. Then, the polymer C flows through circular paths formed around the pipes 6 within holes 7 bored in the plate member 16. Upon leaving the outlet of the pipe 6, each combined stream of the polymers A and B joins with each stream of the polymer C. And, upon entering a funnel-shaped polymer chamber IV bored in a plate member 16′, the combined streams of the polymers A, B and C join together and are extruded through an orifice 9 to form a single composite filament.

Referring to FIG. 1B which is a transverse cross-sectional view of a part of the spinneret assembly, sectioned along the line P–P′ indicated in FIG. 1A, the reference numerals 1, 10 and 12 are holes through which the polymers A, B and C are introduced into the spinneret assembly, respectively. Approximately half of the number of holes 1 are illustrated in the quater circle and the remaining half are not illustrated (the latter half are present in another quater circle not illustrated). A plurality of the sets of holes 1, 10 and 12 can be provided in the plate member 14*c*. In other words, although only one unit for the production of a single composite filament is illustrated in FIGS. 1A and 1B so that the feature of the invention be understood more readily, a plurality of such a unit may be provided in one spinneret assembly.

In the spinneret assembly illustrated in FIG. 1A, the relatively wide holes 1 have a function of substantially uniformly distributing the polymer A therein. The pipes 3 also have a distributing function to some extent, and accordingly, the plate member 14*c* having bored therein the holes 1 may be omitted. It is convenient, however, to provide such a plate member 14*c* because, first, the lowermost constricted portions of the holes 1 have an enhanced function of the polymer distribution and, secondly, a composite filament having core ingredients different from each other in the cross section or thickness can be produced by varying the cross sections of the contricted portions of the holes from each other.

The plate member 14*b* having bored therein the relatively narrow holes 2 which connect the holes 1 with the pipes 3 may also be omitted. It is convenient, however, to provide such a plate member 14*b* because the plate member 14*b* prevents the pipes 3 from upwardly slipping out. It is also possible to bore in the plate member 14*b* holes 2 having a diameter slightly larger than the inner diameter of pipes 6 and to insert into each of the holes a pipe (not illustrated) having the same inner diameter as that of the pipe 3.

The plate member 15*b* having bored therein the holes 5, which function similarly to the holes 2 bored in the plate member 14, may also be omitted. It is convenient, however, to provide such a plate member 15*b* because, first, the lower constricted portion of each hole 5 enhances the distribution of polymer streams as well as prevents the pipe 6 from upwardly slipping out, and secondly, multi-core composite filaments each having an increased number of core ingredients can be advantageously produced.

The cross sections of the funnel-shaped polymer chamber IV and of the orifice 9 are preferably circular, but may be of any other configurations such as, for example, polygonal and multi-armed (e.g., T and Y letter-shaped).

The lengths of the upper pipe 3 and the lower pipe 6 are not particularly limited. The lowermost of the upper pipe 3 may end within the hole 4, at the boundary between the hole 4 and the hole 5 or within the upper part of the hole 5. Similarly, the lowermost of the lower pipe 6 may end within the hole 7, at the boundary between the hole 4 and the polymer chamber IV or within the upper part of the polymer chamber IV.

The number of the core ingredients in each of the composte filaments produced by using the spinneret assembly illustrated in FIGS. 1A and 1B may be varied within the range of from 2 to approximately 10,000, preferably from 2 to approximately 1,000, and more preferably from 4 to approximately 200.

Figure 2:
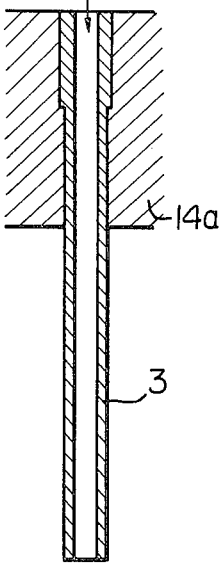
FIG. 2 is a vertical sectional view of a pipe 3 in FIG. 1A, which view illustrates the state in which the pipe 3 is supported by a plate member 14*a;*

Referring to FIG. 2 illustrating the state in which each pipe 3 is supported by the plate member 14*a*, the pipe 3 has a larger outer diameter in the upper portion thereof so that the pipe can be prevented from slipping out from the plate member 14*a* due to the difference in the thermal expansion coefficient between the pipe 3 and the plate member 14*a* or due to the thermal distortion of the pipe 3. Upward slipping out of the pipe 3 can be prevented by the plate member 14*b* (not illustrated in FIG. 2) having bored therein the holes 2, which plate member is superposed on the plate member 14*a*. The fitting of the pipe 3 to the plate member 14*a* may be effected in various ways such as, for example, screwing, clamping, brazing, fusion welding or adhesion. Alternatively, the pipe 3 may be integrated with the plate member 14*a*.

The fitting of the pipe 6 to the plate member 15*a* may be effected in ways similar to those mentioned above in reference to the pipe 3.

In FIG. 1, the circular paths formed around the pipes 3 within the holes 4 and those formed around the pipes 6 within the holes 7 are preferably completely circular. However, they do not have to be completely circular but may be varied depending upon the cross section of the respective pipes and holes. The cross sections of the pipes and the holes may be circular, elliptic, triangular or polygonal. The configurations of these cross sections may be finned or projectional.

Instead of forming the circular path around the pipe 3 and/or 6 within the hole 4 and/or 7 as illustrated in FIG. 1, it is possible to use a slender pipe, which extends downward from the plate member 14*a* and/or 15*a* and ends within the polymer chamber II and/or III, and further use a thick pipe, which extends upward from the hole 4 and/or 7 of the plate member 15*c* and/or 16 so that the uppermost portion of the thick pipe surrounds the lowermost portion of the slender pipe to form a circular path therebetween. Alternatively, it is also possible to use a thick pipe, which extends downward from the plate member 14*a* and/or 15*a* and ends within the polymer chamber II and/or III, and further use a slender pipe, which extends upward from the hole 4 and/or 7 of the plate member 15*c* and/or 16 so that the lowermost portion of the thick pipe surrounds the uppermost portion of the slender pipe to form a circular path therebetween.

Figures 3A, 3B, 3C:
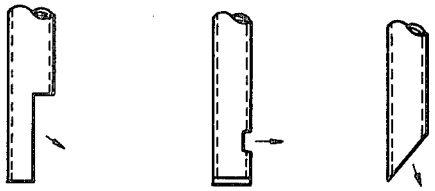
FIGS. 3A, 3B and 3C are schematic views illustrating the lowermost portions of three modified embodiments of the pipe 3 illustrated in FIG. 1A.

The spinneret assembly illustrated in FIGS. 1A and 1B is suitable particularly for the production of a multicore composite filament, the core ingredients of which are of a core-sheath configuration. However, the core-sheath configuration is not necessarily concentric, but may be eccentric. The core-sheath configuration may be varied depending upon the relative position of the pipe 3 to the hole 4. The eccentricity of the core-sheath configuration can be enhanced to various extents by inclining the direction in which the polymer A issues from the pipe 3. For this purpose, pipes having outlet portions as illustrated in FIGS. 3A, 3B and 3C may be used.

In order to uniformly combine the two polymer streams A and B and thus produce composite filaments having an enhanced uniformity in thickness and in cross-section, at least one of the two polymer passages upstream of the joining point, through which passages two polymer streams A and B flow, respectively, must have at least one cross section that is narrower than any cross section of the polymer passage downstream of the joining point but upstream of the succeeding joining point or must have a length longer than that of the polymer passage downstream of the joining point but upstream of the succeeding joining point. For example, in the spinneret assembly illustrated in FIG. 1A, at least either the lowermost constricted portion of hole 1, pipe 3, or the circular path formed around the lowermost portion of the pipe 3 within the hole 4 must have a cross section that is narrower than any cross section of the pipe 6 and than any cross section of the orifice 9, or the length from the inlet end of the holes 1 to the lowermost end of the pipe 3 must be longer than the length from the lowermost end of the pipe 3 to the lowermost end of the pipe 6 and than the length from the lowermost end of the pipe 6 to the outlet end of the orifice 9. Similarly, at least one of the two polymer passages upstream of the joining point, through which passages a combined stream of the polymers A and B and a stream of the polymer C flow, respectively, must have at at least one cross section that is narrower than any cross section of the polymer passage downstream of the joining point, or must have a length longer than that of the polymer passage downstream of the joining point. That is, at least either the pipe 6 or the circular path formed around the lowermost portion of the pipe 6 within the hole 7 must have a cross section narrower than that of the orifice 9, or the length from the lowermost end of the pipe 3 to the lowermost end of the pipe 6 must be longer than the length from the lowermost end of the pipe 6 to the outlet end of the orifice 9. By satisfying these requisites, any polymer stream can be uniformly distributed at the joining point, and thus, composite filaments having an enhanced uniformity in thickness and in cross-section can be produced. If these requisites are not satisfied, a complicated spinneret assembly, which has extra ordinarily large, very precise and difficult to maintain, will be necessary for obtaining the desired uniform composite filaments.

It is more preferable that both of the polymer passages upstream of the joining point have at least one cross section that is narrower than any cross section of the polymer passage downstream of the joining point but upstream of the succeeding joining point, if any, or both of the polymer passages upstream of the joining point have a length longer than that of the polymer passage downstream of the joining point but upstream of the succeeding joining point, if any.

In order to completely prevent any of the core ingredients, which are disposed in close proximity to the outer periphery in the cross section of each composite filament, from being exposed on the surface of each filament, it is preferable that the polymer passages, through which polymer streams forming the above-mentioned peripherally disposed core ingredients flow, are provided at least at a portion of each polymer passage with relatively narrow cross sections, as compared with those provided in the polymer passages through which polymer streams forming the centrally disposed core ingredients flow. Instead of providing the relatively narrow cross sections, it is possible to permit relatively large amounts of the polymer C i.e., the intervening ingredient) to flow through the circular paths formed around the end portions of the pipes through which polymer streams forming the above-mentioned peripherally disposed core ingredients flow.

The core ingredients in a composite filament may be different in thickness from each other. Such a composite filament can be produced by using a spinneret assembly wherein the narrowest cross section of one series of polymer passages, through which a stream of a core-forming polymer ingredient flows, is different in size from the narrowest cross section of at least one of the other series of polymer passages, through which a stream of a core-forming polymer ingredient flows.

The core ingredients of a composite filament may be different in thickness from those of another composite filament. Such composite filaments can be produced by using a spinneret assembly wherein the narrowest cross sections of the respective series of polymer passages, through which the polymer streams forming the core ingredients of one composite filament flow, are different in size from the narrowest cross sections of the polymer passage series through which the polymer streams forming the core ingredients of at least one other composite filament flow.

Figure 4A:
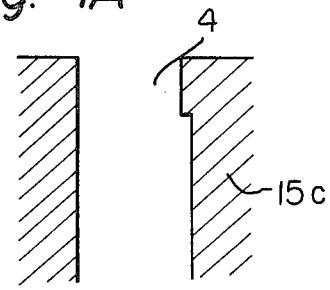
FIGS. 4A and 4B are vertical sectional and plan views of a part of a plate member 15*c* in FIG. 1A, which part illustrates the configuration of a cylindrical hole in the plate member.
Figure 4B:
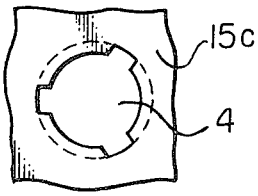

Referring to FIGS. 4A and 4B, which illustrate a modified configuration of the hole 4 in FIG. 1A, the uppermost portion of the hole 4 is constricted. This modification serves to make the distribution of the polymer stream B more uniform, and thus, to make the cross section and thickness of the combined stream of the polymers A and B more uniform. Furthermore, this modification serves to support the pipe 3 (not shown), to be inserted in the hole 4 at the constricted portion thereof, and thus, to minimize undesirable bending of the pipe 3. The constricted portion may be provided in another portion of the hole 4, although it is preferable to provide it in the uppermost portion of the hole as illustrated in FIGS. 4A and 4B. It is preferable that, when the lowermost portion of the hole is constricted, each opening of the constricted portion (through which opening a stream of the polymer B flows) not be positioned in close proximity to any opening of the constricted portion of the adjacent hole 4, so as to mitigate or minimize the non-uniform distribution of the polymer component B around the core polymer component A. The number of openings bored in the constricted portion may be voluntarily varied. Alternatively, the hole 4 may be constricted in another way, e.g., the constricted portion may be formed by making the hole diameter thereof smaller than that of the other portion (although this not illustrated in the figures).

A constricted portion similar to those mentioned above may also be provided in the lower hole 7 bored in the plate member 16. This constricted portion serves to make the cross section and thickness of the combined stream of the sheath polymer C and the core polymers A plus B more uniform, whether the core ingredient of the polymer phases A plus B is of a core-sheath configuration or a side-by-side configuration.

Figure 5:
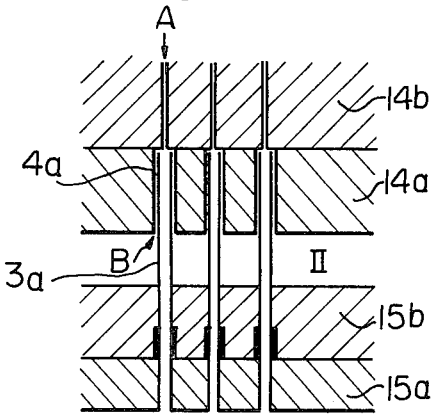
FIG. 5 is a vertical sectional view of a part of another embodiment of the spinneret assembly of the invention.

Instead of forming a circular path around the pipe 3 within the hole 4 as illustrated in FIG. 1A, a circular path, through which a stream of the polymer B flows, may be formed around a pipe 3*a*, extending upward from the plate member 15*a*, within a hole 4*a* bored in the plate member 14*a* as illustrated in FIG. 5.

Figure 6A:
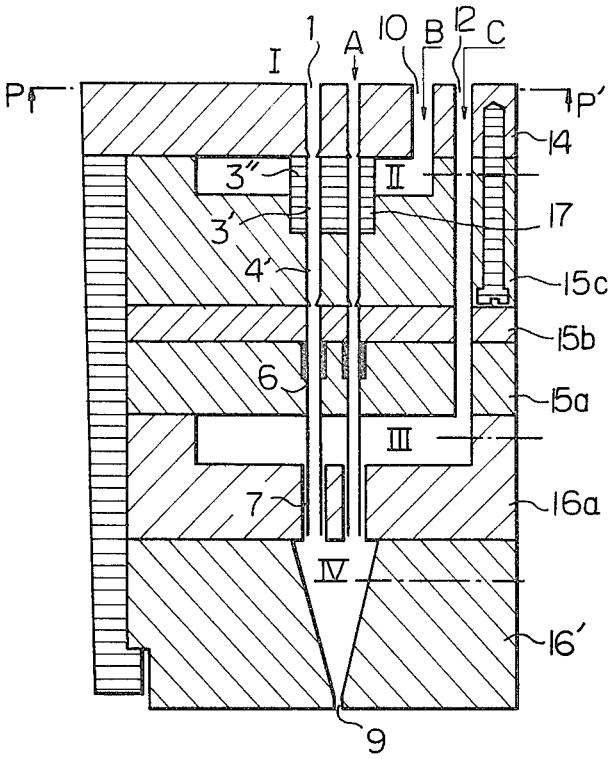
FIG. 6A is a vertical sectional view of a part of still another embodiment of the spinneret assembly of the invention.
Figure 6B:
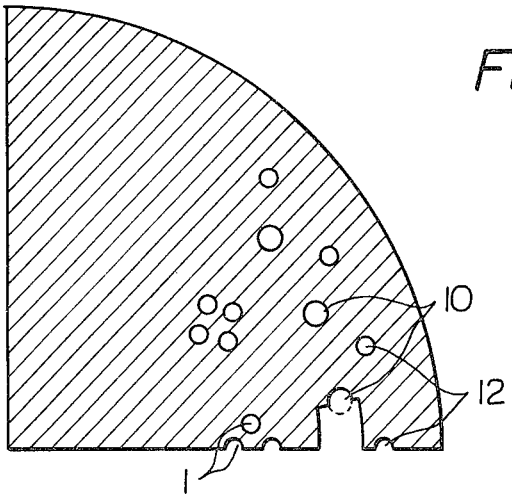
FIG. 6B is a transverse sectional view of a part of the spinneret assembly sectioned along the line P—P' indicated in FIG. 6A.

Referring to FIGS. 6A and 6B which illustrate another embodiment of the spinneret assembly of the present invention, a rigid connecting member 17 sandwiched between plate members 14 and 15C is provided. The connecting member 17 has bored therein a plurality of vertical holes 3' connected with holes 1 and holes 4', bored in the plate members 14 and 15*c*, respectively. The connecting member 17 further has bored therein a plurality of slits 3'', each of which is exposed to a polymer chamber II at one end thereof and to the holes 3' at the other end thereof. Streams of a polymer A are introduced form a polymer chamber I through relatively wide connecting holes 1 into the holes 3'. Streams of a polymer B are introduced from the polymer chamber II through the slits 3'' into the holes 3'. In each hole 3', the polymer stream A and the polymer stream B join together to form a combined stream of a side-by-side configuration. Each combined stream of the polymers A and B flows through the hole 4, and then, through a pipe 6. A stream of a polymer C, introduced from a hole 12 into a polymer chamber III, is divided into circular paths formed around the pipes 6 within holes 7 bored in the plate member 16*a*. Upon leaving the outlet of the pipe 6, each combined stream of the polymers A and B joins with each stream of the polymer C. Upon entering a funnel-shaped polymer chamber IV, the combined streams of the polymers A, B and C join together and are extruded through an orifice 9 to form a single composite filament. The lowermost constricted portion of each of the holes 4' bored in the plate member 15*c* has a function similar to that of the hole 5 illustrated in FIG. 1A.

The above-mentioned embodiment of the spinneret assembly provided with the connecting member 17 is particularly suitable for the production of multi-core composite filaments, each core ingredient being of a side-by-side or bi-metal configuration. However, such a spinneret assembly may be used for the production of multi-core composite filaments, each core ingredient being of a core-sheath configuration, by using the connecting member 17, each vertical hole 3' bored therein being connected to a plurality of radially extending slits 3'' bored in the connecting member 17. The number of core ingredients in each of the multi-core composite filaments produced by using the spinneret assembly with the above-mentioned connecting member 17 may be varied within the range of from 2 to 20 or more, preferably from 2 to 20. When the core ingredients are disposed on one circular line in the cross section of each composite filament, the number of the core-ingredients is preferably within the range of from 2 to 10. When the core ingredients are disposed so that a part of the core ingredients is surrounded by the remaining part of the core ingredients in the cross section of each composite filament, the number of the core ingredients is preferably within the range of from 5 to 20.

Details of the connecting member 17 will be apparent from FIGS. 7A, 7B, 8A and 8B. These figures illustrate two embodiments of the connecting member 17 suitable for the production of multi-core composite filaments, each of which is composed of four core polymer ingredients dispersed in one intervening polymer ingredient C, each of the core polymer ingredients being of a side-by-side configuration and comprised of the polymers A and B.

The connecting member 17 may be in a monobloc body or in an assembly of two or more parts, although the former is preferable. Alternatively, the connecting member may be integrated with either the plate member 14 (in FIG. 6A) or the plate member 15*c* (in FIGS. 6, 7A and 8A). The cross sectional shape and size of each hole 3' and 1 or each slit 3'' may be varied to produce multi-core composite filaments, the core ingredients of which have various cross sectional shapes and sizes, and various combined configurations. The cross-sectional shape of each slit 3'' may be, for example, circular, square, rectangular or wavy rectangular. The angle of each slit 3'' to the hole 3' may also be varied in different manners from those illustrated in FIGS. 7B and 8B. In general, two polymers A and B are different from each other in viscosity and surface active property, and consequently, the interface of the combined two polymer streams is not completely flat but curved.

Figure 7A:
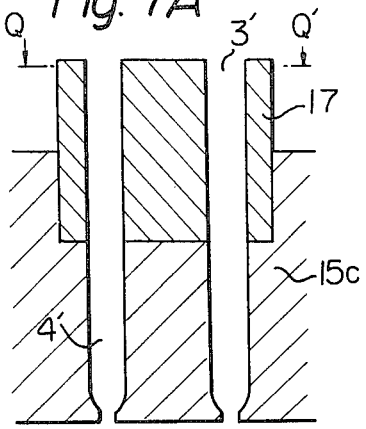
FIG. 7A is an enlarged vertical sectional view of one embodiment of a connecting member 17 illustrated in FIG. 6A.
Figure 8A:
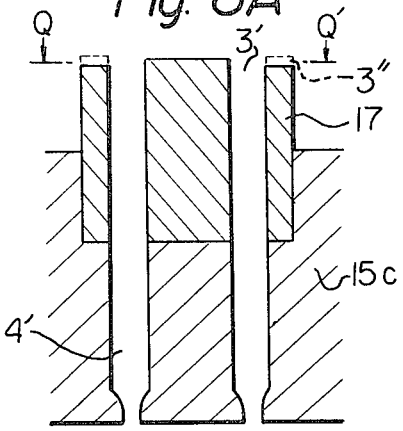
FIG. 8A is an enlarged vertical sectional view of another embodiment of the connecting member 17 in FIG. 6A.
Figure 7B:
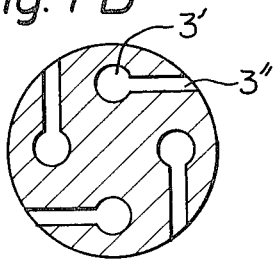
FIG. 7B is a transverse sectional view of the connecting member, sectioned along the line Q—Q' indicated in FIG. 7A.
Figure 8B:
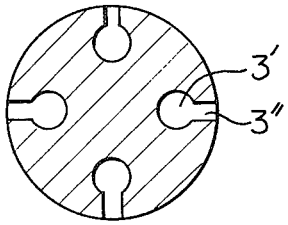
FIG. 8B is a transverse sectional view of the connecting member sectioned along the line Q—Q' indicated in FIG. 8A.

It is preferable to constrict each hole 4' at at least one portion of the hole 4', for example, at the lowermost portion thereof, as illustrated in FIGS. 6, 7A and 8A, in order to effect a uniform distribution of polymer streams.

As one modification of the spinneret assemblies illustrated in FIGS. 1A and 1B, and FIGS. 6A and 6B, a spinneret assembly provided with the two mechanisms of joining together the polymer streams A and B, illustrated in FIG. 1A and FIG. 2A, may also used. By this modification, unique three polymer ingredient, multi-core composite filaments can be obtained, a part of the core ingredients of each composite filament being of a core-sheath configuration and the remaining part of the core ingredients being of a side-by-side configuration.

Figure 9:
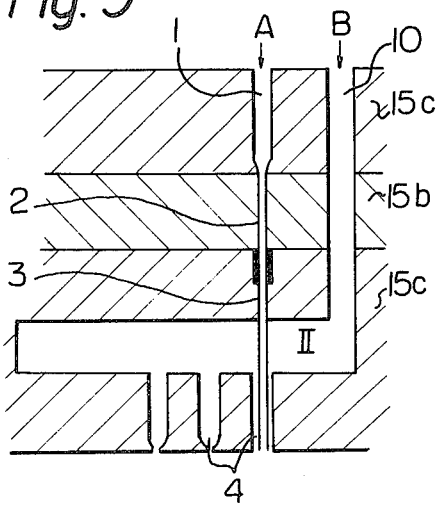
FIGS. 9 and 10 are vertical sectional views of parts of other embodiments of the spinneret assembly of the invention.
Figure 10:
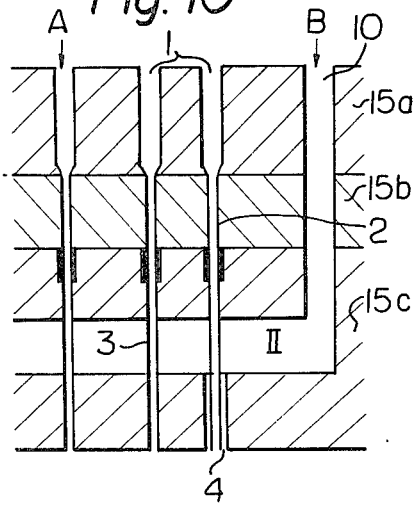

Other modifications of the spinneret assemblies illustrated in FIGS. 1A and 1B, and FIGS. 6A and 6B, will now be described. One modification is illustrated in FIG. 9, in which a part of the polymer streams B flowing through the holes 4 bored in the plate member 15C join with the polymer stream A, and the other part of the polymer streams B do not join with the polymer stream A. Another modification is illustrated in FIG. 10, in which a part of the polymer streams A flowing through the holes 1 join with the polymer stream B and the other part of the polymer streams A do not join with the polymer stream B. Alternatively, these two modifications may be combined, although such combination is not illustrated. Furthermore, the mechanisms of joining together the two polymer streams A and B as illustrated in FIGS. 9 and 10, may be replaced by the mechanism of joining together the two polymer streams A and B as illustrated in FIG. 6A. By using these modified spinneret assemblies, unique multi-core composite filaments can be obtained, a part of the core ingredients of each composite filament being comprised of a polymer A or B, or a core mixture of polymers A and B, and the other part of the core ingredients being comprised of core-sheath type cores of polymers A and B, and/or side-by-side type cores of polymers A and B.

Figure 11A:
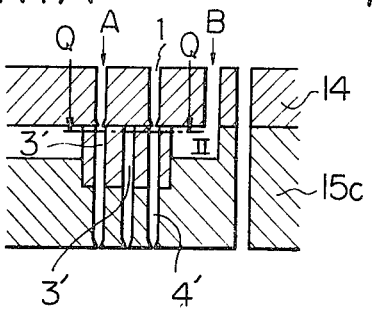
FIG. 11A is a vertical sectional view of a modified embodiment of the connecting member 17 illustrated in FIG. 6A.
Figure 11B:
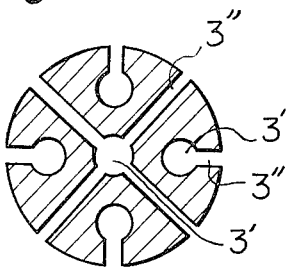
FIG. 11B is a transverse sectional view of the connecting member sectioned along the line Q—Q' indicated in FIG. 11A.

Some modifications of the connecting member, other than those illustrated in FIGS. 7A, 7B, 8A and 8B, will be described with reference to FIGS. 11A through 14C. Referring to FIGS. 11A and 11B, the connecting member has bored therein four holes 3', which connect with the confronting four holes 1 bored in the plate member 14, and one central hole 3', which has no confronting hole 1 bored in the plate member 14. The central hole 3' connects with the polymer chamber II through four radially extending slits 3''. By using this modified connecting member, multi-core composite filaments can be obtained, each of which has a cross-section such that a core ingredient of a polymer B is surrounded by four ingredients, each being of a side-by-side configuration and comprised of polymers A and B. As a further modified embodiment of the spinneret assembly illustrated in FIG. 11A, an additional hole 1 may be bored in the plate member 14, which hole confronts the central hole 3' of the connecting member. This modification results in multi-core composite filaments, each of which has a cross-section such that a core-sheath core ingredient is surrounded by four side-by-side core ingredients.

Figure 12:
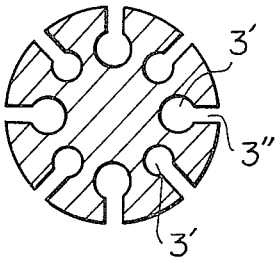
FIGS. 12, 13, 14A, 14B and 14C are similar transverse sectional views of other modified embodiments of the connecting member 17 illustrated in FIG. 6A.
Figure 13:
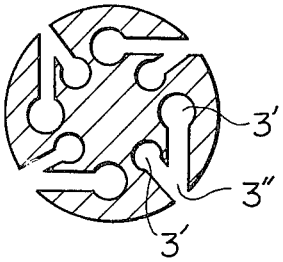
Figure 14A:
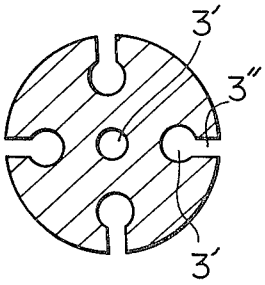
Figure 14B:
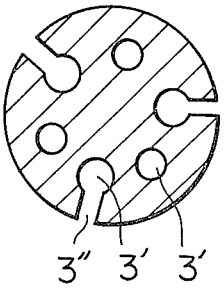
Figure 14C:
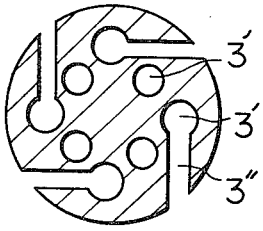

Referring to FIGS. 12 and 13, the functions of the connecting members illustrated therein will be readily understood without an explanation thereof. Furthermore, referring to FIGS. 14A, 14B and 14C, the connecting members illustrated therein are characterized in that a part of the holes 3' bored therein are not connected to the polymer chamber II, so that the resulting composite filaments have a part of the core ingredients which is comprised of a polymer A, and another part which is of a side-by-side configuration and is comprised of polymers A and B.

The cross-sections of examples of the multi-core composite filaments obtained by using spinneret assemblies illustrated in FIGS. 1A and 1B, and FIGS. 6A and 6B, are shown in FIGS. 15A through 15L.

In another embodiment of the spinneret assembly of the invention, the plate member partitioning off the polymer chamber III from one or more funnel-shaped polymer chambers IV has bored therein a plurality of holes, the lowermost ends of which holes are exposed to the or each funnel-shaped polymer chamber IV, and furthermore, which holes are characterized as permitting at least two streams selected from (a) a combined stream of the polymers A and C, (b) a combined stream of the polymers B and C, and (c) a combined stream of the polymers A, B and C, to independently flow into the or each funnel-shaped polymer chamber IV. Two spinneret assemblies illustrated in FIGS. 16A, 16B and 16C, and FIGS. 17A, 17B and 17C, are examples of the above-mentioned embodiment. Each of the multi-core composite filaments obtained by using the spinneret assembly illustrated in FIGS. 16A, 16B and 16C have sixteen core ingredients, ten of which are comprised of the polymer A and surround the other six core ingredients comprised of the polymer B in the cross section of each composite filament. Each of the multi-core composite filaments obtained by using the spinneret assembly illustrated in FIGS. 17A, 17B and 17C also have sixteen core ingredients, eight of which are comprised of the polymer A and the other eight of which are comprised of the polymer B, these sixteen core ingredients being randomly disposed in the cross-section of each composite filament.

Other preferable composite filaments obtained by using spinneret assemblies similar to those illustrated in FIGS. 16A through 17C are as follows. One such composite filament has four or five core ingredients, one to three of which, particularly two of which, are comprised of the polymer A and the others the polymer B. Another of such composite filaments has five to seven core ingredients, one of which is disposed approximately in the center of the cross section of the filament and the others are disposed around the center core ingredient, and one to four of which is comprised of the polymer A and the others the polymer B. The core ingredients in each composite filament may be different from each other in cross-sectional configuration and/or thickness. Such different core composite filaments result in fine filaments having a silk-like hand and feel. Still another preferable composite filament has 15 to 150 core ingredients, and is particularly suitable for high quality woven or knitted fabrics and artificial leathers.

In still another embodiment of the spinneret assembly of the invention, a plate member R partitioning off the polymer chamber I from the polymer chamber II further has bored therein two or more holes, through which streams of one of the plymers A and B flow, immediately upstream of each joining point at which said one of the polymers A and B joins with the other of the polymers A and B, whereby one of the polymers A and B is permitted to join in multi-divided streams with a stream of the other of the polymers A and B.

Figure 18:
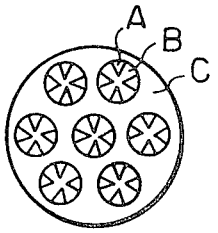
FIGS. 18 and 19 are cross-sections of the composite filaments obtained by using two examples of the spinneret assembly of the invention.
Figure 19:
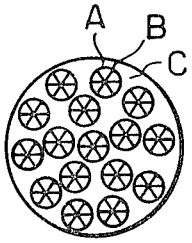
Figure 20A:
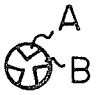
FIGS. 20A through 20E are cross sections of the core ingredients of the composite filaments obtained by using the spinneret assembly of the invention.
Figure 20B:
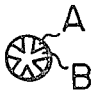
Figure 20C:
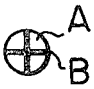
Figure 20D:
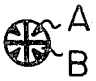
Figure 20E:
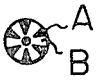

FIGS. 18 and 19 illustrate the cross-sections of two examples of the multi-core composite filaments obtained by using spinneret assemblies according to the above-mentioned embodiment. As illustrated in FIGS. 18 and 19, each of the core ingredients is comprised of the polymers A and B and the intervening ingredient is comprised of the polymer C. However, one of the core ingredient polymers may be the same as the intervening ingredient polymer. For reasons of expediency, the following explanation is presented for the case where each composite filament is comprised of the three polymers A, B and C. Referring to FIGS. 18 and 19, each core ingredient is characterized as having a cross-section such that segments of the polymer A are partitioned off by the polymer B. In FIG. 19, the polymer B is shown as six radially extending lines. Several other examples of the cross-section of the core ingredient are illustrated in FIGS. 20A through 20E. The periphery of each cross section of the core ingredients illustrated in FIGS. 18 through 20E is circular. It should be noted, however, that, as the relative amount of the core ingredient polymer to the amount of the intervening ingredient polymer increases, the periphery of each cross-section gradually changes from a circle to a polygon.

Figure 21:
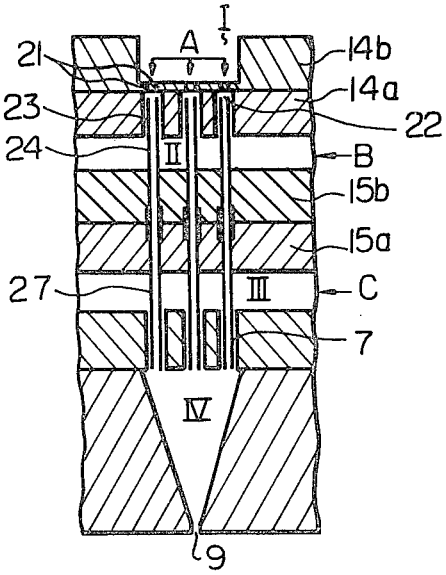
FIG. 21 is a vertical sectional view of a part of still another embodiment of the spinneret assembly of the invention.

Referring to FIG. 21 illustrating a spinneret assembly suitable for the production of multi-core composite filaments similar to those illustrated in FIGS. 18 through 20E, the plate member **14*b* has bored therein a plurality of holes 21 connecting the polymer chamber I with the holes 23. Two or more holes 21 bored in the plate member 14*b* confront each joining point, i.e., the uppermost end 22 of the pipe 24. The polymer A flows through the holes 21 toward each joining point 22, where the polymer streams A join with a polymer stream B flowed from the polymer chamber II through the circular path formed around the pipe 24 within the hole 23. The so formed combined stream of the polymers A and B flows through the pipe 24 and then through the pipe 27. The number of the holes 21** confronting each joining point, i.e., the number of the polymer A segments in each core ingredient, is preferably in the range of from 3 to 10.

Some modifications may be made on the spinneret assembly, illustrated in FIG. 21, as follows. The plate member **14*b* having a concavity, in the bottom of which the holes 21 are bored, may be composed of two members, i.e., a thin plate member having holes 21 bored therein and thick plate member, superposed on the thin plate member, which thick plate member has a large hole bored therein. The plate member 14*a* may be omitted. This is because the gap (illustrated in FIG. 22A by reference numeral 23') between the under surface of the plate member 14*b* and the uppermost end of the pipe 23 has a function of controlling the stream of the polymer B, which function is approximately similar to that of the narrow circular path formed around the pipe 23**.

Figure 22A:
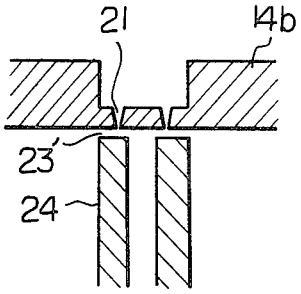
FIG. 22A is an enlarged vertical sectional view of an upper part of a modified embodiment of the spinneret assembly, illustrated in FIG. 21.
Figure 23A:
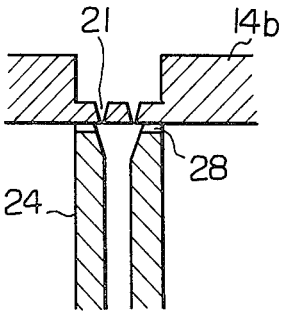
FIG. 23A is an enlarged vertical sectional view of an upper part of another modified embodiment of the spinneret assembly illustrated in FIG. 21.
Figure 22B:
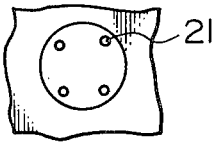
FIG. 22B is a plan view of the upper part of the spinneret assembly illustrated in FIG. 22A.
Figure 23B:
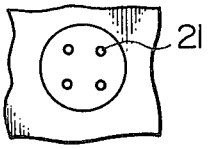
FIG. 23B is a plan view of the upper part of the spinneret assembly illustrated in FIG. 23A.
Figure 22C:
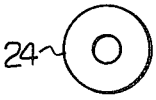
FIG. 22C is a plan view of a pipe 24 illustrated in FIG. 22A.
Figure 23C:
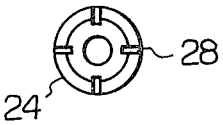
FIG. 23C is a plan view of a pipe 24 illustrated in FIG. 23A.

FIGS. 22A, 22B and 22C and FIGS. 23A, 23B and 23C illustrate modified mechanisms by which the two polymer streams A and B join together, wherein FIGS. 22A and 23A are enlarged vertical sectional views, FIGS. 22B and 23B are plan views and FIGS. 22C and 23C are plan views of the pipes 24. Referring to FIG. 22A, the pipe 24 is positioned so that the uppermost end of the pipe 24 is in close proximity to the under surface of the plate member **14*b*. Referring to FIG. 23A, the pipe 24 is positioned so that the uppermost end of the pipe 24 is in contact with the under surface of the plate member 14*b*. In the modified mechanism illustrated in FIGS. 23A, 23B and 23C, the pipe 24 has four radially extending slits 28 bored in the uppermost end portion thereof, through which streams of the polymer B flow into the pipe 24**.

Although the number of the holes 21 bored in the plate member **14*b*, illustrated in FIGS. 22A through 23C, through which streams of the polymer A flow into the pipe 24, is four, the number of the holes 21 may preferably be varied in the range of from 2 to 10. When the multi-core composite filaments, each core ingredient of which is comprised of core polymer A segments having a large area and an intervening polymer B segment having a small area, are desired, it is convenient that the under surface of the plate member 14*b* or the uppermost end of the pipe 24 be provided with guide members (not shown) forming radially extending slits or grooves through which streams of the polymer are introduced into the proximity of the central axis of the pipe 24**.

The advantages of the spinneret assemblies illustrated in FIGS. 21 through 23C are summarized as follows.

(1) Composite filaments each having a great many fine core ingredients can be readily produced. For example, the composite filament illustrated in FIG. 18 can be regarded as having 28(i.e., $7\times4$) fine core polymer A ingredients. That is, 28 fine filamnets can be obtained therefrom by dissolving out the polymers B and C. If a composite filament having 28 core ingredients is produced by using a conventional spinneret assembly, the spinneret assembly used must be provided with 28 pipes per filament. In contrast, the spinneret assembly of the invention must be provided only with seven pipes per filament. The smaller the number of pipes, the more reduced the pressure drop in polymer streams flowing through the forest of the pipes. Thus, the composite filament or the core ingredients produced by using the spinneret assembly of the invention are uniform in thickness and cross section.

The spinneret assembly of the invention is particularly advantageous in the case where the assembly is provided with ten or more pipes per filament. Furthermore, the spinneret assembly of the invention is small in size per filament.

Similarly, the composite filament illustrated in FIG. 19 can be converted into 96(i.e., $6\times16$) fine polymer A filaments by dissolving out the polymers B and C therefrom. If the polymer B is the same as the polymer C, the dissolution thereof can be effected in a single step.

(2) Fine composite filaments, each comprised of two polymer ingredients, can be obtained. For example, fine composite filaments comprised of polymers A and B can be easily obtained by dissolving out only the intervening polymer C ingredient from the composite filament illustrated in FIG. 18 or 19. If the polymer A possesses little or no affinity for the polymer B, the fine composite filament can be readily divided.

(3) Fine filaments of a special shaped cross section, such as a wedge shaped section, a cross shaped section and an oblong shaped section, can be obtained, for example, by removing the polymers C and either A or B from the composite filaments illustrated in FIGS. 18 through 20E. Fine filaments of such a special shaped section cannot be produced by a conventional spinneret assembly. Furthermore, when one of the core-forming polymers is a polyblend, fine polyblend filaments can be obtained. Such fine polyblend filaments have many applications, such as, for example, anti-static fine filaments.

In still another embodiment of the spinneret assembly of the invention, a plate member S partitions off the polymer chamber III from two or more funnel-shaped polymer chambers IV and has bored therein two or more groups of holes; the lowermost ends of the holes in each group being exposed to each funnel-shaped polymer chamber IV and; furthermore, the respective groups of holes permitting at least two streams selected from (a) a combined stream of the polymers A and C, (b) a combined stream of the polymers B and C, and (c) a combined stream of the polymers A, B and C, to independently flow into different funnel-shaped polymer chambers IV. The two spinneret assemblies illustrated in FIGS. 24 and 25 are examples of the above-mentioned embodiment.

Figure 24:
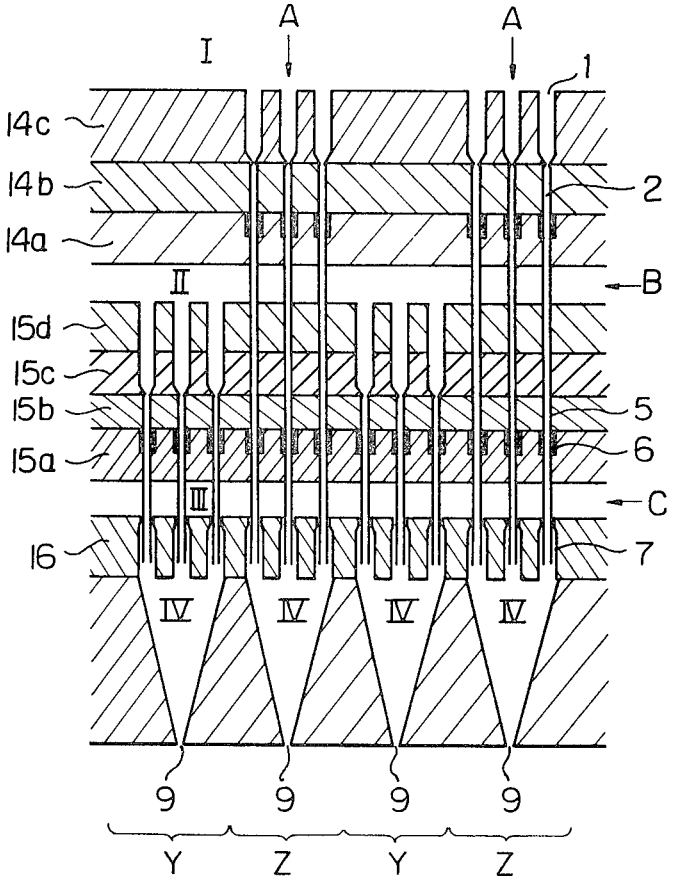
FIG. 24 is a vertical sectional view of a part of still another embodiment of the spinneret assembly of the invention.

Referring to FIG. 24, the spinneret assembly comprises units Y, by which multi-core composite filaments each comprised of core polymer B ingredients and an intervening polymer C ingredient are produced, and units Z, by which multi-core composite filaments each comprised of core polymer A ingredients and an intervening polymer C ingredient are produced. These multi-core composite filaments are formed in a state such that the composite filaments of one type intervene between the composite filaments of the other type, or surround the composite filaments of the other type. Thus, the two type composite filaments are obtained in a state wherein they are mixed to the desired extent. Therefore, by chemically or physically removing the intervening polymer C ingredients from the composite filaments, a bundle of fine filaments can be obtained which is comprised of small bundles of fine polymer A filaments and small bundles of fine polymer B filaments, the two type bundles being mixed with each other to the desired extent.

Figure 25:
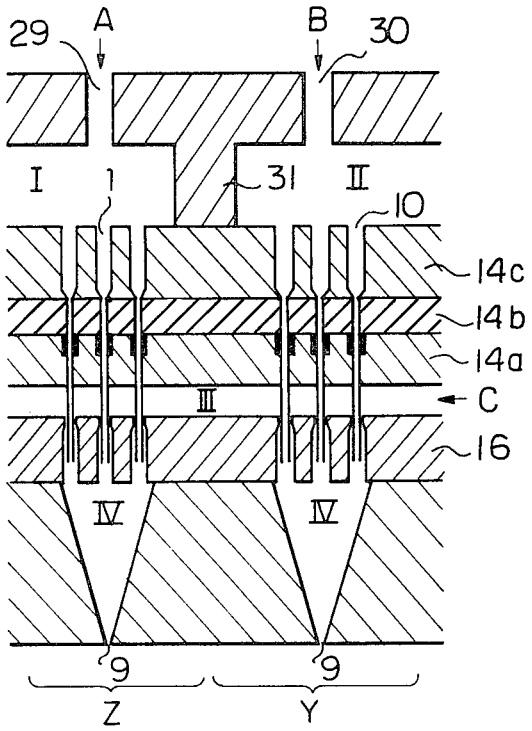
FIG. 25 is a vertical sectional view of a part of still another embodiment of the spinneret assembly of the invention.

Referring to FIG. 25 illustrating a modification of the spinneret assembly in FIG. 24, the polymer A introduced through a hole 29 into the polymer chamber I flows into holes I bored in the plate member 14*c* and the polymer B introduced through a hole 30 into the polymer chamber II flows into holes 10 bored in the plate member 14*c*. The two polymer chambers I and II are partitioned off from each other by a partition wall 31. The plate member 14*a* illustrated in FIG. 25 corresponds to a combination of the two plate members 14*a* and 15*a* illustrated in FIG. 24. As compared with the spinneret assembly illustrated in FIG. 24, the spinneret assembly illustrated in FIG. 25 is advantageous in that the cost of its equipment in less, but fine filaments finally obtained by using the spinneret assembly in FIG. 25 are somewhat poor in filament distribution.

Figure 26:
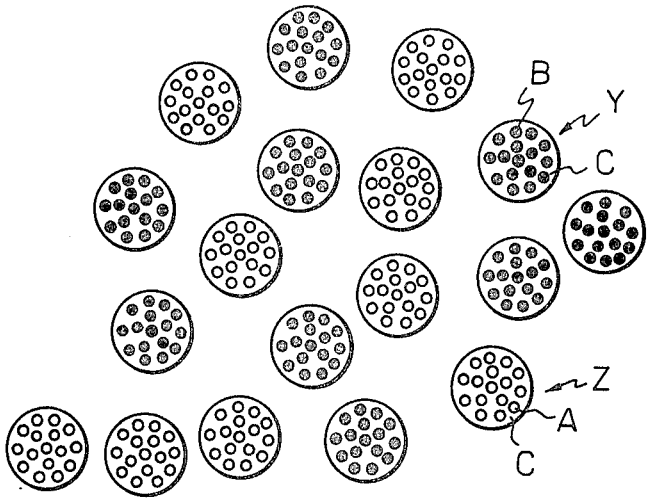
FIGS. 26 and 27 are cross-sectional views of the composite filaments obtained by using the spinneret assemblies illustrated in FIGS. 24 and 25.
Figure 27:
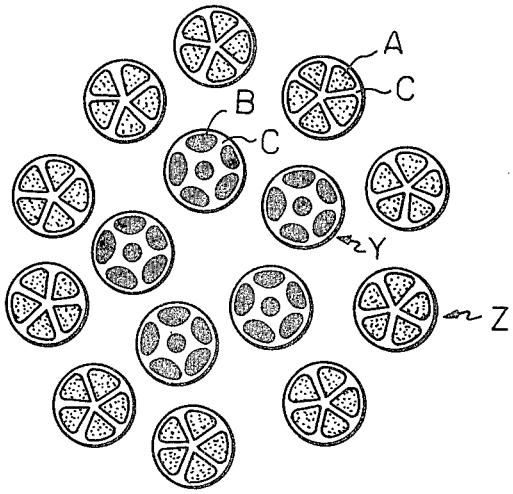

The cross sections of two examples of the bundles of composite filaments obtained by using the spinneret assemblies illustrated in FIGS. 24 and 25 are illustrated in FIGS. 26 and 27. In these two composite filament bundles, the composite filaments of a Z type comprised of the polymers A and C intervene between the composite filaments of a Y type comprised of the polymers B and C as illustrated in FIG. 26, or the former type composite filaments surround the latter type composite filaments as illustrated in FIG. 27. By removing or separating the intervening polymer C ingredients from the respective bundles of the composite filaments, a mixture of the two type fine filament bundles is obtained in the desired mixed state. Such desired mixed state cannot be obtained by conventional doubling and twisting procedures wherein two type fine filament bundles separately prepared are doubled and twisted.

The above-mentioned mixture of the two type fine filament bundles can be used in various ways. For example, special textile products are obtained by a combination of a non-shrinkable polymer A and a shrinkable polymer B, a combination of two polymers A and B different in dye-receptive properties or resistance to attack by chemicals, or a combination of a colored polymer A and a non-colored polymer B. Also, various raised textile products of different softness, hand, feel and denseness can be obtained. Furthermore, silk-like, wool-like and suede-like textile products can also be obtained.

In another embodiment of the spinneret assembly of the invention, the plate member S, which partitions off the polymer chamber III from one or more funnel-shaped polymer chambers IV and has bored therein a plurality of holes, the lowermost ends of the holes being exposed to the or each funnel-shaped polymer chamber IV, is characterized as further having bored therein one or more slits through which streams of the polymer C flow from he polymer chamber III to the funnel-shaped polymer chamber IV, the or each slit being, on the under surface of the plate member S, of a multi-arm shape having at least three radially extending arms, each of which intervenes between at least two holes of the holes bored in the plate member S. Spinneret assembly illustrated in FIGS. 29 through 32, FIGS. 33 through 37, FIGS. 38 through 41 and FIGS. 42 through 48 are four examples of the above-mentioned embodiment of the invention.

Figure 28A:
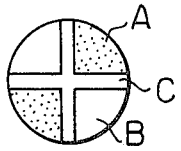
FIGS. 28A through 28I are cross-sectional views of various composite filaments obtained by using spinneret assemblies illustrated in FIGS. 29 through 48.
Figure 28B:
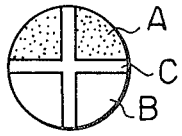

Referring to FIGS. 29 through 32, the spinneret assembly illustrated therein is suitable for the production of multi-core composite filaments each of which has a cross section as illustrated in FIG. 28B. The polymer C introduced through a hole 12 into the polymer chamber III flows through slits 32, bored in a projecting part 31 of the plate member, into the funnel-shaped polymer chamber IV where the stream of the polymer C joins with two polymer streams A and two polymer streams B, flowing through the holes 33 and 34, respectively.

Referring to FIGS. 33 through 37, the spinneret assembly illustrated therein is approximately similar to that in FIGS. 29 through 32, wherein two polymer streams A flowing through holes 37 and, then, through holes 38, and two polymer stream B flowing through holes 40 and, then, through holes 41, join together with a stream of the polymer C issuing from a slit 35. The cross shaped slit, through which the polymer C flows from the polymer chamber III to the funnel shaped chamber IV, is comprised of a wide introductory part 36 and a narrow part 35.

Figure 38:
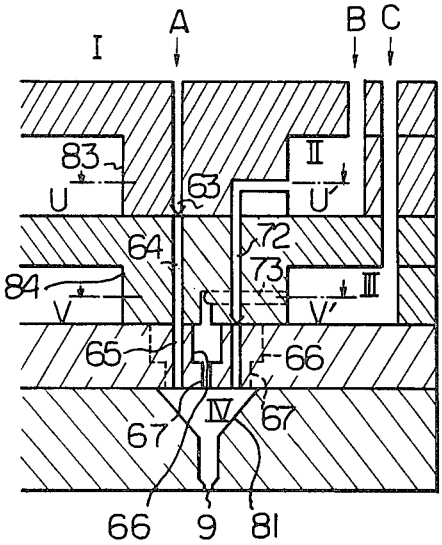
FIG. 38 is a vertical sectional view of a part of still another embodiment of the spinneret assembly of the invention.
Figure 39:
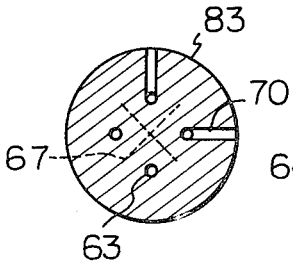
FIGS. 39 and 40 are transverse sectional views of the part of the spinneret assembly sectioned along the lines U–U′ and V–V′, respectively, indicated in FIG. 39.
Figure 40:
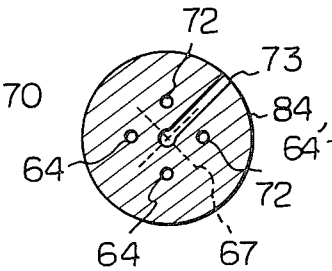
Figure 41:
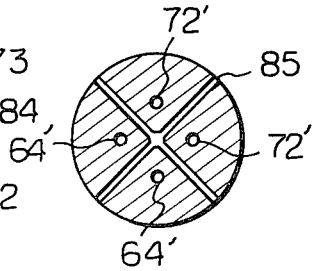
FIG. 41 is a transverse sectional view, sectioned similarly to in FIG. 40, of a part of a modified embodiment of the spinneret assembly of the invention.

Referring to FIGS 38 through 40, the spinneret assembly illustrated therein is approximately similar to that in FIGS. 33 through 37, wherein a polymer C stream flows through a hole 73, a bore 66 and, then, a hole 66, and then, joins with two polymer A streams issuing from holes 65 and with two polymer B streams issuing from holes 72. FIG. 41 illustrates a part of a modified embodiment of the spinneret assembly in FIGS. 38 through 40, said part corresponding to FIG. 40. In this modified spinneret assembly, the polymer C flows through four radially extending holes 85, instead of one hole 73 in FIG. 40.

Figure 28C:
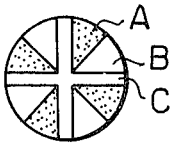
Figure 28D:
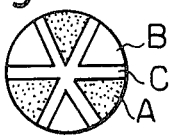
Figure 28E:
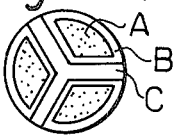
Figure 28F:
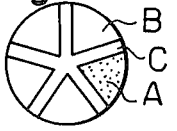
Figure 28G:
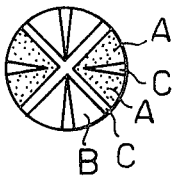
Figure 42:
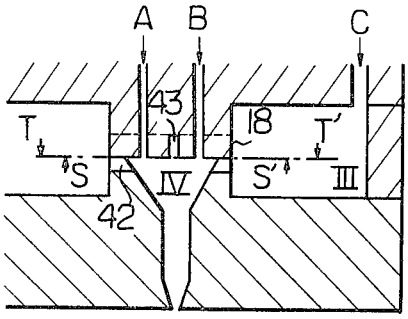
FIG. 42 is a vertical sectional view of a part of still another embodiment of the spinneret assembly of the invention.
Figure 43:
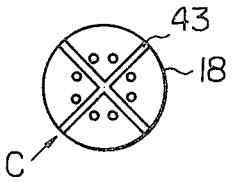
FIGS. 43 and 44 are transverse sectional views of the part of the spinneret assembly, sectioned along the lines S–S′ and T–T′, respectively, indicated in FIG. 42.
Figure 44:
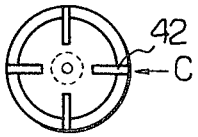

Referring to FIGS. 42 through 44, the spinneret assembly illustrated therein is a modification of the spinneret assembly in FIGS. 29 through 32 and is suitable for the production of multi-core composite filaments, each of which has a cross section as illustrated in FIG. 28G. This modified spinneret assembly is characterized in that four radially extending grooves 42 are provided in the upper periphery of the funnel-shaped polymer chamber IV, through which grooves a portion of the polymer C flow into the polymer chamber IV. This portion of the polymer C forms wedge shaped areas intervening in the polymer segments A and B as illustrated in FIG. 28G.

Figure 28H:
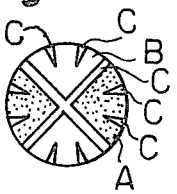
Figure 28I:
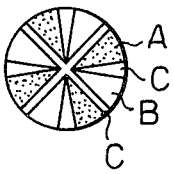
Figure 29:
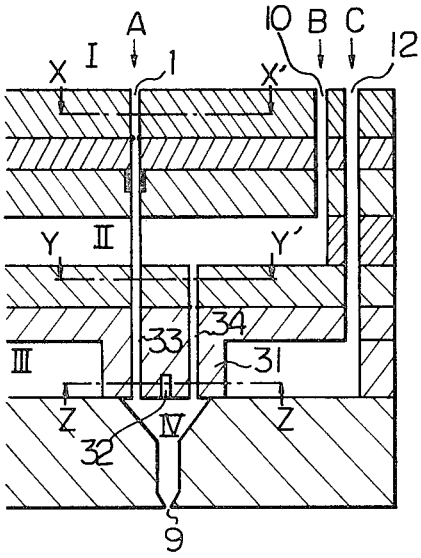
FIG. 29 is a vertical sectional view of a part of still another embodiment of the spinneret assembly of the invention.
Figure 30:
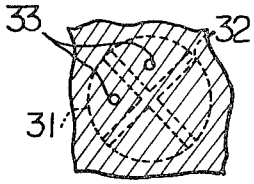
FIGS. 30, 31 and 32 are transverse sectional views of a part of the spinneret assembly sectioned along the lines X-X', Y-Y' and Z-Z', respectively, indicated in FIG. 29.
Figure 31:
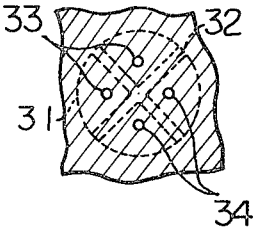
Figure 32:
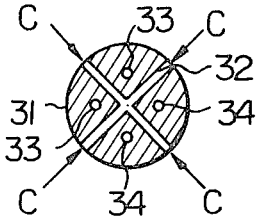
Figure 33:
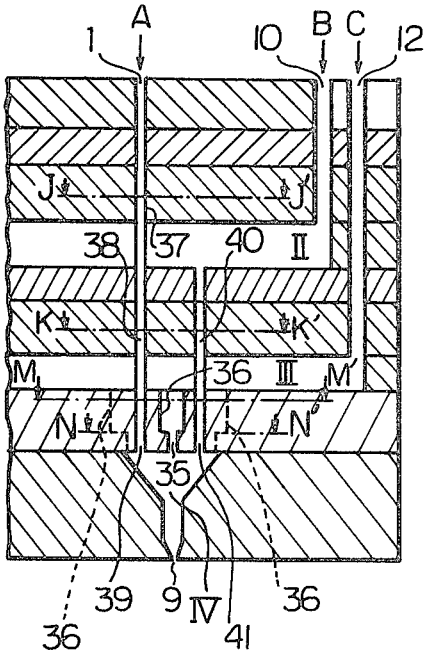
FIG. 33 is a vertical sectional view of a part of still another embodiment of the spinneret assembly of the invention.
Figure 34:
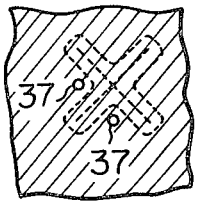
FIGS. 34, 35, 36 and 37 are transverse sectional views of a part of the spinneret assembly sectioned along the lines J-J', K-K', M-M' and N-N', respectively, indicated in FIG. 33.
Figure 35:
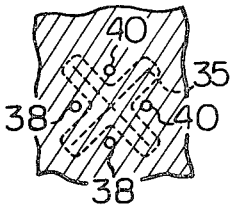
Figure 36:
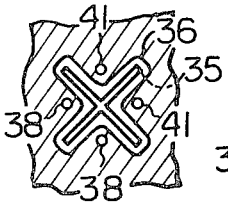
Figure 37:
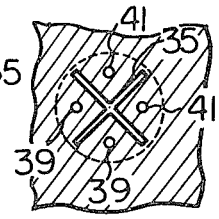
Figure 45:
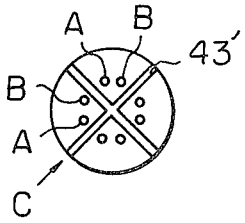
FIGS. 45 and 46 are transverse sectional views of a part of a modified embodiment of the spinneret assembly of the invention.
Figure 46:
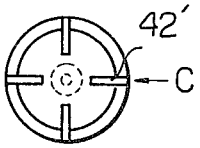
Figure 47:
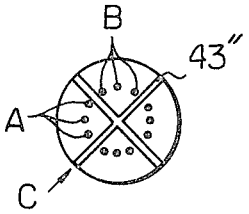
FIGS. 47 and 48 are transverse sectional views of a part of another modified embodiment of the spinneret assembly of the invention.
Figure 48:
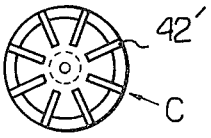

FIGS. 45 and 46 are transverse cross sections illustrating a part of a modified spinneret assembly which is approximately similar to that illustrated in FIGS. 42 through 44 and is suitable for the production of multi-core composite filaments each having a cross section as illustrated in FIG. 28I. FIGS. 47 and 48 are also transverse cross sections illustrating a part of another modified spinneret assembly which is approximately similar to that in FIGS. 42 through 44 and is suitable for the production of multi-core composite filaments each having a cross section as illustrated in FIG. 28H. Vertical cross sections of these modified spinneret assemblies are approximately similar to that shown in FIG. 42 and, hence, are not illustrated herein.

Several examples of the multi-core composite filaments obtained by using the spinneret assemblies of the type similar to those illustrated in FIGS. 29 through 48 are illustrated in cross section in FIGS. 28A through 28I. These composite filaments are comprised of a plurality of segments of three polymers A, B and C. When the segments of three polymers A, B and C are separated from each other by chemical and/or physical means, a mixture of fine filaments or a bundle of fine composite filaments is obtained. That is, when the composite filaments are treated with a solvent capable of selectively dissolving the polymer C, the resulting filaments are comprised of the polymers A and B. In contrast, when the segments of the polymers A, B and C are mechanically separated from each other, the resulting fine filaments are comprised of the polymer C as well as the polymers A and B. At least a part of the polymer C present in the resulting fine filaments is multi-arm shaped.

In the cross sections illustrated in FIGS. 28A, 28B and 28C, the respective polymer C segments are of the same cross-shaped configuration as each other, but the polymer A segments and the polymer B segments are different from each other. The cross sectional configuration of the polymer C segment may be any multi-arm shape, other than cross-shaped, as illustrated in FIGS. 28D, 28E and 28F. The number of arms of the multi-arm shape may be varied, preferably within the range of from 3 to 30. It is also possible to provide each arm with one or more branched or crossed arms, although this not illustrated. Furthermore, the core polymer A segments and the core polymer B segments are, preferably, symmetrically disposed about the center of the cross section of each composite filament, as illustrated not in FIGS. 28B and 28F but in FIGS. 28A, 28C, 28D and 28E. This is because the composite filament having a symmetrical cross section is not liable to be curled and possesses good working properties. The composite filaments obtained by one and the same spinneret assembly may be different from each other in cross section and/or in thickness.

In the cross section illustrated in FIG. 28G, a portion of the polymer C segments are wedge-shaped. Each of the wedge-shaped polymer C segments has a function of, when the composite filament is subjected to a chemical or physical dividing treatment, dividing each core segment of the polymer A or B or A+B, located at both sides of each wedge-shaped polymer C segment, into two segments. The cross section illustrated in FIG. 28H is similar to that in FIG. 28G, except that two wedge-shaped polymer C segments intervene within each of the polymer A and B segments. The cross section illustrated in FIG. 28I is also similar to that in FIG. 28G, except that a polymer A segment is located at one side of each wedge-shaped polymer C segment and a polymer B segment at the other side thereof. This composite filament in FIG. 28I is characterized in that, when it is subjected to a chemical or physical dividing treatment, the polymer A segment and the polymer B segment located at both sides of each wedge-shaped polymer C segment are readily separated from each other and the resulting fine filaments are a uniform mixture comprising polymer A filaments and polymer B filaments.

The multi-core composite filaments illustrated with reference to FIGS. 28A through 28E further have the following advantages. First, since the intervening polymer C ingredient is of a multi-arm shape, each arm extending radially, the multi-core composite filaments can be produced without undesirable separation of the core and intervening ingredients during their manufacture, even when the polymer C is poor in affinity for the polymers A and B. Secondly, the cross section of each composite filament is symmetrical about the center, and therefore, the composite filament is not liable to develop crimps and possesses good working properties. Thirdly, the intervening polymer C ingredient having a multi-arm shape cross section can be made thin, and therefore, when the intervening polymer C ingredient is dissolved out from the composite filament, the dissolution loss can be minimized.

Figure 49:
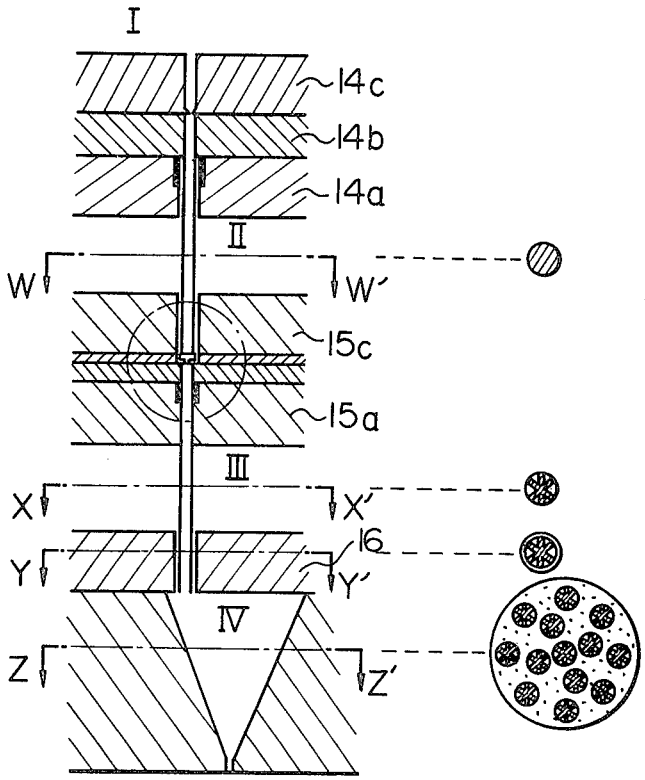
FIG. 49 is a diagrammatical, vertical sectional view of the spinneret assembly of the invention, which illustrates an example of one series of vertically linked polymer passages.
Figure 50:
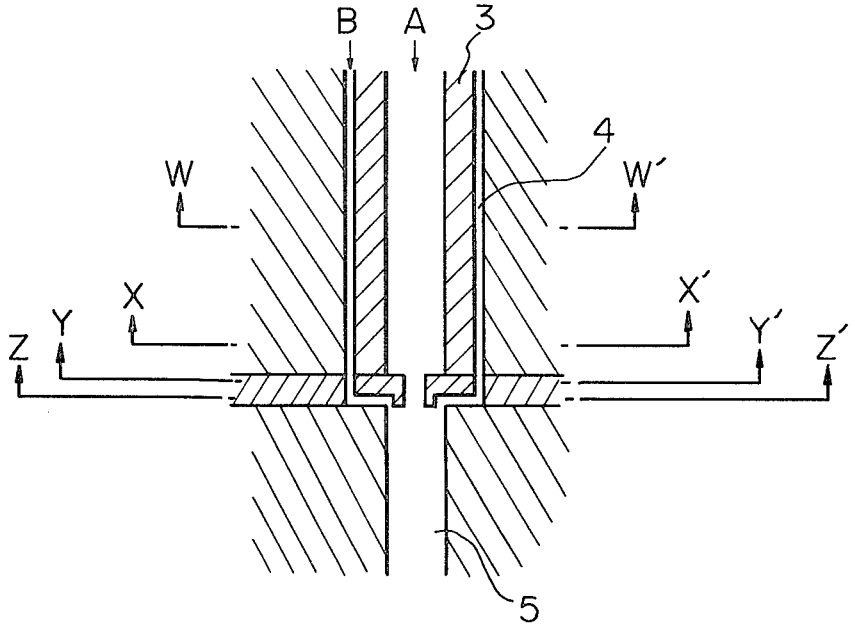
FIG. 50 is an enlarged vertical sectional view illustrating the circled portion in FIG. 49.
Figure 51A:
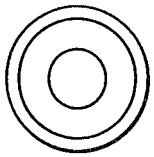
FIGS. 51A, 51B, 51C and 51D are transverse sectional views of the part of the spinneret assembly, sectioned along the lines W–W′, X–X′, Y–Y′ and Z–Z′, respectively, indicated in FIG. 50.
Figure 51B:
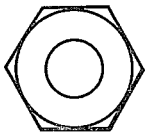
Figure 51C:
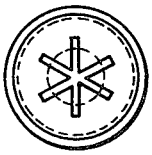
Figure 51D:
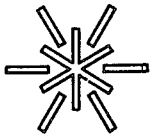

FIG. 49 illustrates a typical example of the vertically linked polymer passages through which a stream of the polymer A, a combined stream of the polymers A and B and a combined stream of the polymers A, B and C flow, respectively. For a convenience sake, only one series of the passages are illustrated therein. The figure on the right side of FIG. 49 illustrate the cross sections of the polymer streams, sectioned along the lines W—W', X—X', Y—Y' and Z—Z', respectively. FIG. 50 is an enlarged vertical sectional view illustrating the circled portion in FIG. 49. FIGS. 51A, 51B, 51C and 51D are cross sections, sectioned along the lines W—W', X—X', Y—Y' and Z—Z', respectively, of FIG. 50.

Figure 52:
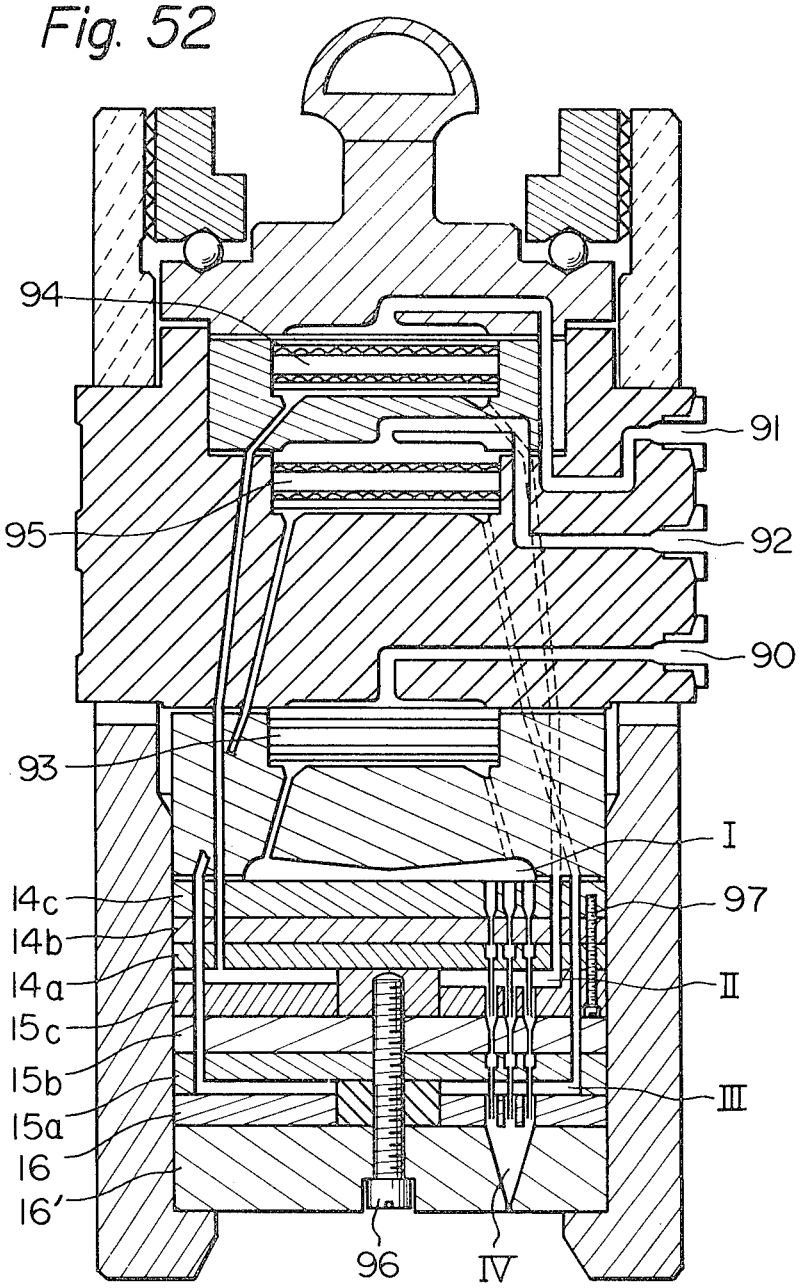
FIG. 52 is a vertical sectional view of a spinning pack having fitted therein the spinneret assembly of the invention.

FIG. 52 illustrates a spinning pack having fitted therein the spinneret assembly of the invention. The polymers A, B and C are independently introduced from outlets 90, 91 and 92 through filter assemblies 93, 94 and 95 into the polymer chambers I, II and III, respectively. The spinneret assembly of the invention is preferably characterized in that, after at least the plate members forming the polymer chambers II and III (i.e., the plate members 14*a*, 15*c*, 15*b*, 15*a* and 16, more preferably the plate members 14*c*, 14*b*, 14*a*, 15*c*, 15*b*, 15*a*, 16 and 16') are assembled into a spinneret assembly unit by using one or more bolts 96 and 97, the spinneret assembly unit can be fitted into the spinning pack.

Figure 53:
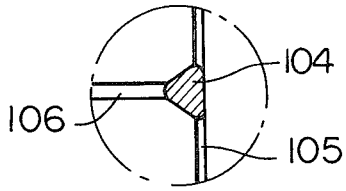
FIGS. 53 and 53A is a diagrammatical, vertical sectional view of a spinning pack having fitted therein a spinning assembly not of the invention.
Figure 53A:
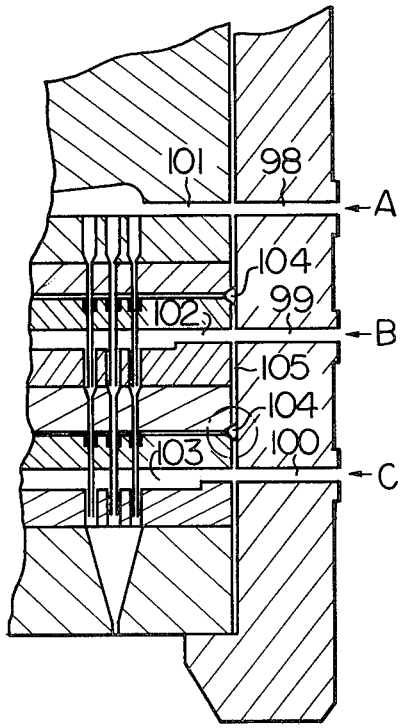

Furthermore, the spinneret assembly of the invention is preferably characterized as not having two or more polymer-introducing passages which open at the side wall of the spinneret assembly. FIGS. 53 and 53A diagrammatically illustrates a spinning pack having fitted therein a spinneret assembly having two polymer-introducing passages 102 and 103 opening at the side wall of the spinneret assembly. In this spinning pack, minor portions of the polymer streams A, B and C introduced from introducing passages 98, 99 and 100, respectively, bored in the spinning pack, inevitably penetrate into a narrow cylindrical gap 105 between the outer wall of the spinneret assembly and the inner wall of the spinning pack. In order to prevent the polymer streams A, B and C, which have penetrated into the gap 105, from being contaminated with each other, O-rings 104 must be provided within the gap 105 as illustrated in a circled, enlarged cross sectional view in the upper right portion of FIG. 53. However, such provision of O-rings inevitably forms gap 106 between the plate members, causing mutual contamination of the polymer streams which flow downward through the vertically linked polymer passages (illustrated in FIG. 49).

The shape of the spinneret assembly of the invention is not particularly limited. The shape may be columnar or square pillar-shaped, although the former is preferable.

The plate members may be made of various rigid materials. The rigid materials used include, for example, stainless steel, such as SUS-32 or -27, iron, titanium, glass, quartz, ceramics, gold, platinum and rigid plastics. These material may be used alone or in combination.

The polymers, which flow through the spinneret assembly of the invention, may be either in a molten form or in a solution form. The polymers used in a molten form include, for example, fiber-forming polyesters, polyamides, polyolefins, styrene polymers, polyurethanes and modified vinyl polymers. The polymers used in a solution form include, for example, polyamides, acrylic polymers, vinyl polymers, polyvrethanes and cellulose acetate. It is not a requirement that each, of the three polymers A, B and C may be a single polymer, and each may be a polyblend comprised of two or more polymers. It is also possible that the intervening polymer ingredient is the same as one of the core polymer ingredients.

The multi-ingredient multi-core composite filaments obtained by using the spinneret assembly of the invention have many applications. For example, the following filaments or yarn can be produced from the multi-core composite filaments.

(1) Fine core-sheath type composite filaments.

(2) Fine side-by-side type composite filaments.

(3) Combined filament yarns comprised of different fine filaments.

(4) Fine multi-core core-sheath type filaments.

(5) Combined filament yarns comprised of bundles of different fine filaments.

(6) A combination of at least two of the above-mentioned filaments and yarns.

The following fabrics can be produced from the above-listed fine filaments and yarns.

(1) Deeply colored fabrics. These fabrics can be manufactured from fine core-sheath type composite filaments, the core ingredients of which are prepared from a pigmented polymer, or from post-dyed products of the fine core-sheath filaments. Fine side-by-side type composite filaments are not suitable for this use because pigment tends to come off from the filaments in the step of dividing the filaments.

(2) Bulky fabrics, particularly raised fabrics. These fabrics can be manufactured from combined filament yarns comprised of fine filaments of different shrinkage or from fine side-by-side type filaments. Although side-by-side type filaments do not exhibit a great crimp-developing capability, they result in densified raised fabrics.

(3) Fabrics with a moire' finish. These fabrics are made of fine filaments divided from multi-core composite filaments, which have cross sections such that different core ingredients are unevenly distributed therein, or which are comprised of different multi-core composite filaments. The division of the multi-core composite filaments may be carried out either prior to or after the formation of fabrics.

It is expected that the multi-core composite filaments produced by using the spinneret assembly of the invention have various applications, other than those wherein they are used as fine filaments. The complicated and unique design for the cross-sectional configurations of the multi-core composite filaments will produce their unique uses.

What we claim is:

1. A spinneret assembly to be fitted in a spinning pack for the production of multi-ingredient multi-core composite filaments comprised of at least three polymer phases A, B and C, which assembly comprises superposed rigid first, second, third and fourth plate members;

said first plate member partitioning off a first polymer chamber, through which a stream of the polymer A flows, from a second or third polymer chamber, through which a stream of the polymer B or C flows, respectively;

said third plate member partitioning off the third polymer chamber from one or more funnel-shaped fourth polymer chambers bored in the fourth plate member, through which combined streams of the polymers A, B and C flow, and said third plate member having bored therein a plurality of holes, the lowermost ends of which are exposed to the or each funnel-shaped fourth polymer chamber;

said fourth plate member having at the lowermost end of the or each funnel-shaped fourth polymer chamber an orifice through which a combined stream of the polymers A, B and C flows; with the proviso that one of the following requisites (a) and (b) is satisfied:

(a) said second plate member having bored therein a plurality of holes confronting the holes of the third plate member, each pair of confronting holes being connected with each other by a pipe, said pipe extending from the hole of the second plate member toward the hole of the third plate member or from the hole of the third plate member toward the hole of the second plate member, so that a narrow circular path is formed at least around one end portion of said pipe within the hole of the third plate member or the second plate member, respectively, or within another pipe extending from the hole of the second plate member or the third plate member, respectively, and the polymer passage formed within said pipe being connected through said narrow circular path to the third polymer chamber;

(b) said third plate member further having bored therein one or more slits through which streams of the polymer C flow from the third polymer chamber to the funnel-shaped fourth polymer chamber, the or each slit being, on the under surface of the third plate member, of a multi-arm shape having at least three radially extending arms, each of which intervenes between at least two holes of the holes bored in the third plate member, said first, second, third and fourth plate members forming a plurality of series of linked polymer passages each series having at least one joining point at which two polymer streams join together, at least one of the polymer passages upstream of the joining point having at least one cross section that is narrower than any cross section of the polymer passage downstream of the joining point but upstream of the succeeding joining point, if any, or said at least one polymer passage upstream of the joining point having a length longer than that of the polymer passage downstream of the joining point but upstream of the succeeding joining point, if any;

said first rigid plate member having bored therein connecting holes for connecting each pair of the respective confronting holes bored in the first and second plate members and further having bored therein slits extending from a part or all of said connecting holes to the polymer chamber II, whereby the polymer passages formed within a part or all of said connecting holes are connected through said slits to the second polymer chamber so that at least two type core ingredients different in composition are formed in each multi-core composite filament; and at least said first, second and third plate members being capable of being assembled into a single unit by connecting means so that the first, second and third plate members can be fitted in or detached from the spinning pack as the single unit, and said single unit having only one or no polymer-introducing passage which opens at the side wall of the single unit and having two or more polymer-introducing passages which open at the upper face of the single unit so that mutual contamination of the polymers is prevented.

2. A spinneret assembly to be fitted in a spinning pack for the production of multi-ingredient multi-core composite filaments comprised of at least three polymer phases A, B and C, which assembly comprises superposed rigid first, second, third and fourth plate members;

said first plate member partitioning off a first polymer chamber, through which a stream of the polymer A flows, from a polymer chamber second or third, through which a stream of the polymer B or C flows, respectively;

said second plate member partitioning off the second polymer chamber from the third polymer chamber;

said third plate member partitioning off the third polymer chamber from one or more funnel-shaped fourth polymer chambers bored in the fourth plate member, through which combined streams of the polymers A, B and C flow, and said third plate member having bored therein a plurality of holes, the lowermost ends of which are exposed to the or each funnel-shaped fourth polymer chamber;

said fourth plate member having at the lowermost end of the or each funnel-shaped fourth polymer chamber an orifice through which a combined stream of the polymers A, B and C flows; with the proviso that one of the following requisites (a) and (b) is satisfied:

(a) said second plate member having bored therein a plurality of holes confronting the holes of the third plate member, each pair of confronting holes being connected with each other by a pipe, said pipe extending from the hole of the second plate member toward the hole of the third plate member or from the hole of the third plate member toward the hole of the second plate member, so that a narrow circular path is formed at least around one end portion of said pipe within the hole of the third plate member or the second plate member, respectively, or within another pipe extending from the hole of the second plate member or the third plate member, respectively, and the polymer passage formed within said pipe being connected through said narrow circular path to the third polymer chamber;

(b) said third plate member further having bored therein one or more slits through which streams of the polymer C flow from the third polymer chamber to the funnel-shaped fourth polymer chamber, the or each slit being, on the under surface of the third plate member, of a multi-arm shape having at least three radially extending arms, each of which intervenes between at least two holes of the holes bored in the third plate member;

said first, second, third and fourth plate members forming a plurality of series of linked polymer passages each series having at least one joining point at which two polymer streams join together, at least one of the polymer passages upstream of the joining point having at least one cross section that is narrower than any cross section of the polymer passage downstream of the joining point but upstream of the succeeding joining point, if any, or said at least one polymer passage upstream of the joining point having a length longer than that of the polymer passage downstream of the joining point but upstream of the succeeding joining point, if any;

said second plate member further having bored therein two or more holes, through which streams of one of the polymers A and B flow, immediately upstream of each joining point at which said one of the polymers A and B joins with the other of the polymers A and B, whereby one of the polymers A and B is permitted to join in multi-divided streams with a stream of the other of the polymers A and B; and at least said first, second and third plate members being capable of being assembled into a single unit by connecting means so that the first, second and third plate members can be fitted in or detached from the spinning pack as the single unit, and said single unit having only one or no polymer-introducing passage which opens at the side wall of the single unit and having two or more polymer-introducing passages which open at the upper face of the single unit so that mutual contamination of the polymers is prevented.

3. A spinneret assembly to be fitted in a spinning pack for the production of multi-ingredient multi-core composite filaments comprised of at least three polymer phases A, B and C, which assembly comprises superposed rigid first, second, third and fourth plate members;

said first plate member partitioning off a first polymer chamber, through which a stream of the polymer A flows, from a second or third polymer chamber, through which a stream of the polymer B or C flows, respectively;

said second plate member partitioning off the second polymer chamber from the third polymer chamber;

said third plate member partitioning off the third polymer chamber from one or more funnel-shaped fourth polymer chambers bored in the fourth plate member, through which combined streams of the polymers A, B and C flow, and said plate members having bored therein a plurality of holes, the lowermost ends of which are exposed to the or each funnel-shaped polymer chamber;

said fourth plate member having at the lowermost end of the or each funnel-shaped fourth polymer chamber an orifice through which a combined stream of the polymers A, B and C flows; with the proviso that one of the following requisites (a) and (b) is satisfied:

(a) said second plate member having bored therein a plurality of holes confronting the holes of the third plate member, each pair of confronting holes being connected with each other by a pipe, said pipe extending from the hole of the second plate member toward the hole of the third plate member or from the hole of the third plate member toward the hole of the second plate member, so that a narrow circular path is formed at least around one end portion of said pipe within the hole of the third plate member or the second plate member, respectively, or within another pipe extending from the hole of the second plate member or the third plate member, respectively, and the polymer passage formed within said pipe being connected through said narrow circular path to the third polymer chamber;

(b) said third plate member further having bored therein one or more slits through which streams of the polymer C flow from the polymer chamber to the funnel-shaped fourth polymer chamber, the or each slit being, on the under surface of the third plate member, of a multi-arm shape having at least three radially extending arms, each of which intervenes between at least two holes of the holes bored in the third plate member;

said first, second, third and fourth plate members forming a plurality of series of linked polymer passages each series having at least one joining point at which two polymer streams join together, at least one of the polymer passages upstream of the joining point having at least one cross section that is narrower than any cross section of the polymer passage downstream of the joining point but upstream of the succeeding joining point, if any, or said at least one polymer passage upstream of the joining point having a length longer than that of the polymer passage downstream of the joining point but upstream of the succeeding joint point, if any;

said plurality of holes bored in the third plate member, the lowermost ends of which holes are exposed to the or each funnel-shaped fourth polymer chamber, permitting at least two streams selected from (a) a stream of the polymer A or a combined stream of the polymers A and C, (b) a stream of the polymer B or a combined stream of the polymers B and C, and (c) a combined stream of the polymers A and B or a combined stream of the polymers A, B and C, to independently flow into the or each funnel-shaped fourth polymer chamber; and at least said first, second and third plate members being capable of being assembled into a single unit by connecting means so that the first, second and third plate members can be fitted in or detached from the spinning pack as the single unit, and said single unit having only one or no polymer-introducing passage which opens at the side wall of the single unit and having two or more polymer-introducing passages which open at the upper face of the single unit so that mutual contamination of the polymers is prevented.

4. A spinneret assembly to be fitted in a spinning pack for the production of multi-ingredient multi-core composite filaments comprised of at least three polymer phases A, B and C, which assembly comprises superposed rigid first, second, third and fourth plate members;

said first plate member partitioning off a first polymer chamber, through which a stream of the polymer A flows, from a second or third polymer chamber, through which a stream of the polymer B or C flows, respectively;

said second plate member partitioning off the second polymer chamber from the third polymer chamber;

said third plate member partitioning off the third polymer chamber from one or more funnel-shaped fourth polymer chambers bored in the fourth plate member, through which combined streams of the polymers A, B and C flow, and said plate members having bored therein a plurality of holes, the lowermost ends of which are exposed to the or each funnel-shaped fourth polymer chamber;

said fourth plate member having at the lowermost end of the or each funnel-shaped polymer fourth chamber an orifice through which a combined stream of the polymers A, B and C flows; with the proviso that one of the following requisites (a) and (b) is satisfied:

(a) said second plate member having bored therein a plurality of holes confronting the holes of the third plate member, each pair of confronting holes being connected with each other by a pipe, said pipe extending from the hole of the second plate member toward the hole of the third plate member or from the hole of the third plate member toward the hole of the second plate member, so that a narrow circular path is formed at least around one end portion of said pipe within the hole of the third plate member or the second plate member, respectively, or within another pipe extending from the hole of the second plate member or the third plate member, respectively, and the polymer passage formed within said pipe being connected through said narrow circular path to the third polymer chamber;

(b) said third plate member further having bored therein one or more slits through which streams of the polymer C flow from the third polymer chamber to the funnel-shaped fourth polymer chamber, the or each slit being, on the under surface of the third plate member, of a multi-arm shape having at least three radially extending arms, each of which intervenes between at least two holes of the holes bored in the third plate member;

said first, second, third and fourth plate members forming a plurality of series of linked polymer passages each series having at least one joining point at which two polymer streams join together, at least one of the polymer passages upstream of the joining point having at least one cross section that is narrower than any cross section of the polymer passage downstream of the joining point but upstream of the succeeding joining point, if any, or said at least one polymer passage upstream of the joining point having a length longer than that of the polymer passage downstream of the joining point but upstream of the succeeding joining point, if any;

said third plate member partitioning off the third polymer chamber from two or more funnel-shaped fourth polymer chambers and having bored therein two or more groups of holes, the lowermost ends of the holes in each group being exposed to each funnel-shaped fourth polymer chamber, whereby the respective groups of holes permit at least two streams selected from (a) a stream of the polymer A or a combined stream of the polymers A and C, (b) a stream of the polymer B or a combined stream of the polymers B and C, and (c) a combined stream of the polymers A and B or a combined stream of the polymers A, B and C, to flow into different funnel-shaped fourth polymer chambers; and at least said first, second and third plate members being capable of being assembled into a single unit by connecting means so that the first, second and third plate members can be fitted in or detached from the spinning pack as the single unit, and said single unit having only one or no polymer-introducing passage which opens at the side wall of the single unit and having two or more polymer-introducing passages which open at the upper face of the single unit so that matual contamination of the polymers is prevented.

5. A spinneret assembly according to claims 1, 2, 3 or 4, wherein the narrowest cross section of one series of polymer passages, through which a stream of a core-forming polymer ingredient flows, is different in size from the narrowest cross section of at least one of the other series of polymer passages, through which a stream of a core-forming polymer ingredient flows, whereby there are formed composite filaments each having at least two core ingredients which are different in thickness from each other.

6. A spinneret assembly according to claims 1, 2, 3 or 4, wherein the narrowest cross sections of the respective series of polymer passages, through which the polymer streams forming the core ingredients of one composite filament flow, are different in size from the narrowest cross sections of the polymer passage series through which the polymer streams forming the core ingredients of at least one other composite filament flow, whereby there are formed composite filaments, at least two of which are different from each other in the thickness of the respective core ingredients.

7. A spinneret assembly according to claims 1, 2, 3 or 4 wherein both of the polymer passages upstream of the joining point have at least one cross section that is narrower than any cross section of the polymer passage downstream of the joining point but upstream of any succeeding joining point, both of the polymer passages upstream of the joining point have a length longer than that of the polymer passage downstream of the joining point but upstream of any succeeding joining point.

8. A spinneret assembly according to claims 1, 2, 3 or 4 wherein both of the polymer passages upstream of the joining point have a length longer than that of the polymer passage downstream of the joining point but upstream of any succeeding joining point.

* * * * *

UNITED STATES PATENT AND TRADEMARK OFFICE

CERTIFICATE OF CORRECTION

PATENT NO. : 4,370,114

DATED : January 25, 1983

INVENTOR(S) : Miyoshi Okamoto et al

It is certified that error appears in the above-identified patent and that said Letters Patent is hereby corrected as shown below:

Column 2, line 48, delete "partioning" and insert --partitioning--

Column 13, line 11, delete "plymers" and insert --polymers--

Column 14, line 42, delete "filamnets" and insert --filaments--

Column 15, line 66, delete "in" and insert --is--

Column 16, line 43, delete "assembly' and insert --assemblies--

Column 26, line 9, delete "matual" and insert --mutual--

Signed and Sealed this

*Fifth* Day of *July 1983*

[SEAL]

*Attest:*

GERALD J. MOSSINGHOFF

*Attesting Officer* *Commissioner of Patents and Trademarks*